US007384352B2

(12) United States Patent
Ohama et al.

(10) Patent No.: US 7,384,352 B2
(45) Date of Patent: Jun. 10, 2008

(54) GOLF BALL

(75) Inventors: Keiji Ohama, Kobe (JP); Kazuhiko Isogawa, Kobe (JP); Takahiro Sajima, Kobe (JP)

(73) Assignee: SRI Sports Limited, Kobe-shi, Hyogo (JP)

( * ) Notice: Subject to any disclaimer, the term of this patent is extended or adjusted under 35 U.S.C. 154(b) by 0 days.

(21) Appl. No.: 11/647,199

(22) Filed: Dec. 29, 2006

(65) Prior Publication Data

US 2007/0173350 A1 Jul. 26, 2007

(30) Foreign Application Priority Data

Jan. 24, 2006 (JP) ..... 2006-014601
Jan. 24, 2006 (JP) ..... 2006-014668

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,744,564 A * 5/1988 Yamada ..... 473/379
5,072,945 A * 12/1991 Oka et al. ..... 473/384
5,090,705 A * 2/1992 Oka et al. ..... 473/384
5,156,404 A * 10/1992 Oka et al. ..... 473/382
5,902,192 A 5/1999 Kashiwagi et al.
6,066,055 A 5/2000 Nishino
6,213,896 B1 4/2001 Higuchi et al.
2002/0173380 A1 11/2002 Ohama et al.

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a center 8, mid layer 10 and a cover 6. The mid layer 10 is formed by a resin composition containing a metal oxide with a three-dimensional shape. A D hardness of the mid layer 10 is 32 or greater and 39 or less. A ratio of an amount of compressive deformation C1 of the center 8 to an amount of compressive deformation C2 of a core 4, (C1/C2), is less than 1.09. A ratio of the amount of compressive deformation C1 to an amount of compressive deformation C3, (C1/C3), is equal to or greater than 1.08. This golf ball has three or more kinds of dimples 12, each having a different diameter. Total number of the dimples 12 is equal to or greater than 300. A ratio Pn of the number of the dimples 12 with a diameter of equal to or greater than 3.40 mm to the total number of the dimples is equal to or greater than 90%. The number of kinds of the dimples having a diameter of equal to or greater than 3.40 mm in a low latitude region is greater than that in a middle region and a high latitude region.

16 Claims, 13 Drawing Sheets

C
D
B
B
C
C
B
B
B
C
C
B
D
C
A
B
C
A
B
A
B
A
C
D
B
C
A
B
C
A
B
C
A

GOLF BALL

This application claims priority on Patent Application No. 2006-14601 filed in JAPAN on Jan. 24, 2006 and Patent Application No. 2006-14668 filed in JAPAN on Jan. 24, 2006. The entire contents of these Japanese Patent Applications are hereby incorporated by reference.

BACKGROUND OF THE INVENTION

1. Field of the Invention

The present invention relates to golf balls. More particularly, the present invention relates to multi piece golf balls having a center, a mid layer and a cover.

2. Description of the Related Art

Golf balls have numerous dimples on the surface thereof. The dimples cause turbulent flow separation through disrupting the air flow around the golf ball during the flight. By causing the turbulent flow separation, a separating point of air from the golf ball shifts backwards leading to the reduction of drag. The turbulent flow separation promotes the differential between upper separating point and lower separating point of the golf ball, which results from the backspin, thereby enhancing a lift force that acts upon the golf ball. The reduction of drag and the enhancement of lift force are referred to as "dimple effect". Excellent dimples disturb the air flow more efficiently. The excellent dimples achieve great flight distance.

A mold for a golf ball consists of an upper mold half and a lower mold half. Each of the upper mold half and the lower mold half has a hemispherical cavity face. When the upper and the lower mold are mated, a spherical cavity is formed. This mold has a parting line between the upper and the lower mold half. The parting line is a great circle. On a surface of a golf ball, a portion which corresponds to the parting line is referred to as an equator (or a seam). The equator is a great circle. The vicinity of the equator is a particular region. In the vicinity of the equator, dimples tend to be arranged orderly. The orderly arranged dimples deteriorate the dimple effect. JP-A No. 2000-93556 (U.S. Pat. No. 6,066,055) discloses a proposal to remove the particularity in the equator vicinity region.

Flight performance of a golf ball greatly depends on its resilience performance. JP-A No. 10-179799 (U.S. Pat. No. 5,902,192) discloses a golf ball with a core containing aluminum borate whiskers. This golf ball is excellent in resilience performance.

For a golf ball, feel at impact as well as flight performance is important. JP-A No. 2000-70412 (U.S. Pat. No. 6,213,896) discloses a golf ball with a proper amount of compressive deformation. This golf ball is excellent in feel at impact.

Further, durability is also important for a golf ball. JP-A No. 2002-239033 (US No. 2002/0173380) discloses a golf ball with a cover formed by two layers. This golf ball is excellent in feel at impact and durability.

Golf players desire further improvement in performance of golf balls. An object of the present invention is to provide a golf ball which is excellent in flight performance, feel at impact and durability.

SUMMARY OF THE INVENTION

A golf ball according to one aspect of the present invention has a spherical core and a cover positioned outside of the core. The core has a spherical center and a mid layer positioned outside of the center. The mid layer comprises a polymer composition containing a metal oxide with a three-dimensional shape. A D hardness of the mid layer is 32 or greater and 39 or less. A ratio of an amount of compressive deformation C1 of the center to an amount of compressive deformation C2 of the core, (C1/C2), is less than 1.09. A ratio of the amount of compressive deformation C1 of the center to an amount of compressive deformation C3 of the golf ball, (C1/C3), is equal to or greater than 1.18. This golf ball has three or more kinds of dimples, each having a different diameter, on the surface thereof. Total number of the dimples is 300 or greater. A ratio Pn of the number of the dimples with a diameter of equal to or greater than 3.40 mm to the total number of the dimples is equal to or greater than 90%. NL and NH, which represent the number of kinds of the dimples, meet the following formula (I).

$$NL-NH \geqq 0 \quad \text{(I)}$$

In the above formula (I), NL represents the number of kinds of the dimples being located in a low latitude region whose latitude is 0 degree or greater and less than 30 degrees, and having a diameter of equal to or greater than 3.40 mm. NH represents the number of kinds of the dimples being located in a high latitude region whose latitude is 30 degrees or greater and 90 degrees or less, and having a diameter of equal to or greater than 3.40 mm. Further, NL, NHm and NHp, which represent the number of kinds of the dimples, meet the following formula (II).

$$NL > NHm \geqq NHp \quad \text{(II)}$$

In the above formula (II), NL represents the number of kinds of the dimples being located in the low latitude region whose latitude is 0 degree or greater and less than 30 degrees, and having a diameter of equal to or greater than 3.40 mm. NHm represents the number of kinds of the dimples being located in a middle region whose latitude is 30 degrees or greater and less than 60 degrees, and having a diameter of equal to or greater than 3.40 mm. NHp represents the number of kinds of the dimples being located in a polar region whose latitude is 60 degrees or greater and 90 degrees or less, and having a diameter of equal to or greater than 3.40 mm.

A golf ball according to another aspect of the present invention has a spherical center, a mid layer positioned outside of this center and a cover positioned outside of this mid layer. The mid layer comprises a polymer composition containing a metal oxide with a three-dimensional shape. A D hardness of the mid layer is 30 or greater and 45 or less. A D hardness of the cover is 59 or greater. A difference between an amount of compressive deformation C1 of the center and an amount of compressive deformation C3 of the golf ball, (C1-C3) is equal to or less than 0.75 mm. This golf ball has three or more different kinds of dimples, each having a different diameter, on the surface thereof. Total number of the dimples is 300 or greater. A ratio Pn of the number of the dimples with a diameter of equal to or greater than 3.40 mm to the total number of the dimples is equal to or greater than 90%. NL and NH, which represent the number of kinds of the dimples, meet the following formulae (I) and (II).

$$NL-NH \geqq 0 \quad \text{(I)}$$

$$NL > NHm \geqq NHp \quad \text{(II)}$$

In the golf ball according to the present invention, the great number of kinds of the dimples being located in the low latitude region (i.e. the vicinity of the equator) promotes the dimple effect in this low latitude region. In this golf ball, the mid layer containing a metal oxide with a three-dimensional shape contributes to resilience performance. With a great dimple effect and a great resilience performance, a great flight distance is achieved. This metal oxide does not deteriorate feel at impact and durability. This golf ball is excellent in all terms of the flight performance, feel at impact and durability.

DESCRIPTION OF THE PREFERRED EMBODIMENTS

The present invention is hereinafter described in detail with appropriate references to the accompanying drawing according to the preferred embodiments.

Figure 1:
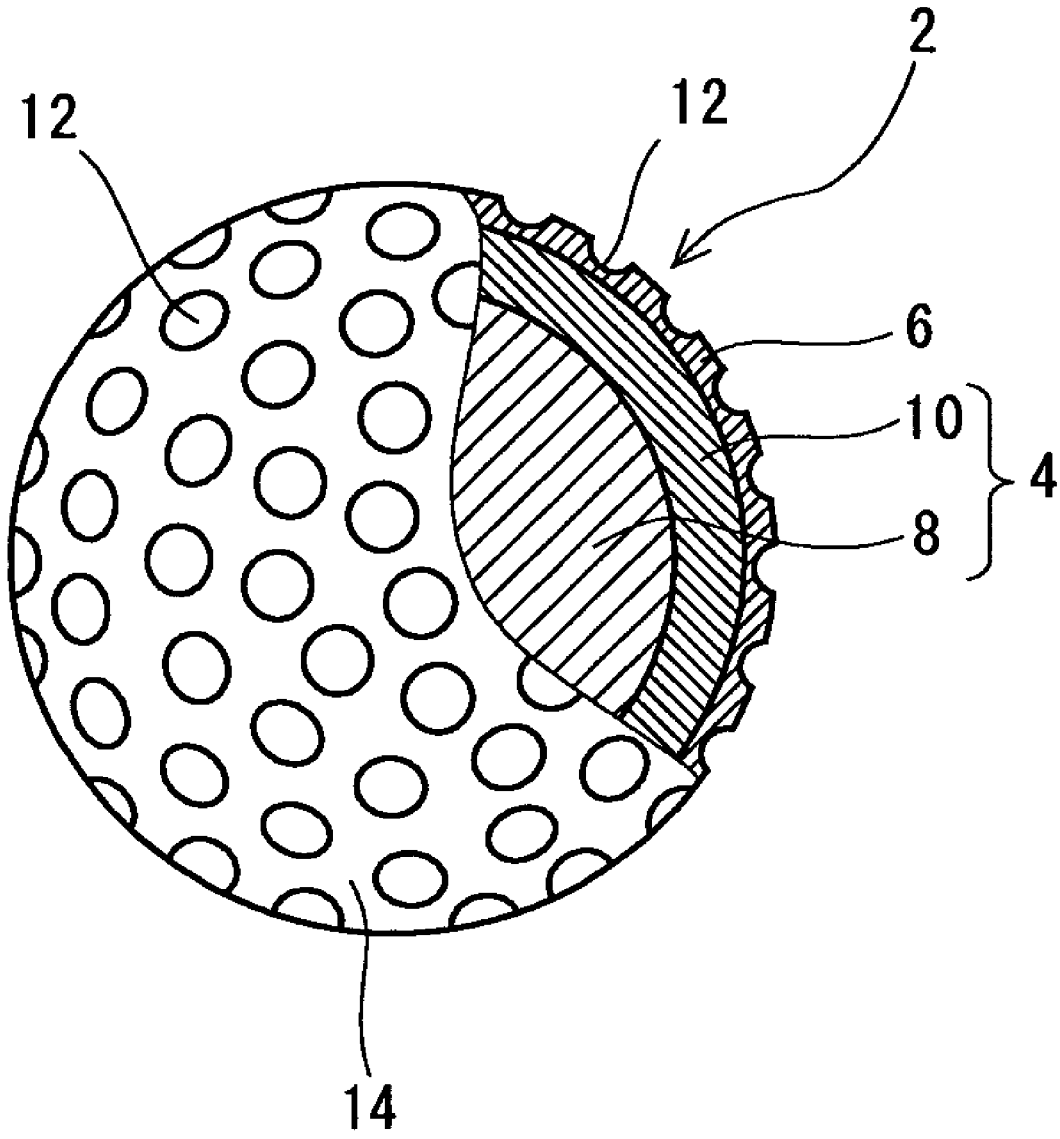
FIG. 1 is a schematic cross-sectional view illustrating a golf ball according to one embodiment of the present invention.

A golf ball 2 illustrated in FIG. 1 has a spherical core 4 and a cover 6 covering the core 4. The core 4 comprises a spherical center 8 and a mid layer 10 covering the center 8. Numerous dimples 12 are formed on the surface of the cover 6. A part of the surface of the golf ball 2 except for the dimples 12 is a land 14. This golf ball 2 has a paint layer and a mark layer to the external side of the cover 6, although these layers are not shown in the Figure. Another layer may be formed between the center 8 and the mid layer 10. Another layer may be provided between the mid layer 10 and the cover 6.

This golf ball 2 has a diameter of from 40 mm to 45 mm. From the standpoint of conformity to the rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to the rule defined by USGA, the weight is more preferably equal to or less than 45.93 g.

The center 8 is obtained through crosslinking a rubber composition. Illustrative examples of preferred base rubber include polybutadienes, polyisoprenes, styrene-butadiene copolymers, ethylene-propylene-diene copolymers and natural rubbers. In light of resilience performance, polybutadienes are preferred. When other rubber is used in combination with polybutadiene, it is preferred that polybutadiene is included as a principal component. Specifically, the proportion of polybutadiene to the total base rubber is preferably equal to or greater than 50% by weight, and particularly preferably equal to or greater than 80% by weight. Polybutadienes, which have a percentage of cis-1,4 bond of equal to or greater than 40%, and particularly equal to or greater than 80%, are preferred.

For crosslinking of the center 8, a co-crosslinking agent is preferably used. Preferable co-crosslinking agent in light of resilience performance is a monovalent or bivalent metal salt of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the ground that a high resilience performance can be achieved.

As a co-crosslinking agent, an α,β-unsaturated carboxylic acid having 2 to 8 carbon atoms, and an oxidized metal may be blended. Both components react in the rubber composition to give a salt. This salt contributes to the crosslinking reaction. Examples of preferable α,β-unsaturated carboxylic acid include acrylic acid and methacrylic acid. Examples of preferable oxidized metal include zinc oxide and magnesium oxide.

In light of resilience performance of the golf ball 2, the amount of the co-crosslinking agent to be blended is preferably equal to or greater than 10 parts by weight, and more preferably equal to or greater than 15 parts by weight per 100 parts by weight of the base rubber. In light of soft feel at impact, the amount of the co-crosslinking agent to be blended is preferably equal to or less than 50 parts by weight, and more preferably equal to or less than 45 parts by weight per 100 parts by weight of the base rubber.

Preferably, the rubber composition of the center 8 includes an organic peroxide together with the co-crosslinking agent. The organic peroxide serves as a crosslinking initiator. The organic peroxide contributes to resilience performance of the golf ball 2. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of resilience performance of the golf ball 2, the amount of the organic peroxide to be blended is preferably equal to or greater than 0.1 part by weight, more preferably equal to or greater than 0.3 part by weight, and particularly preferably equal to or greater than 0.5 part by weight per 100 parts by weight of the base rubber. In light of the soft feel at impact, the amount of the organic peroxide to be blended is preferably equal to or less than 3.0 parts by weight, more preferably equal to or less than 2.8 parts by weight, and particularly preferably equal to or less than 2.5 parts by weight per 100 parts by weight of the base rubber.

Preferably the rubber composition of the center 8 includes an organic sulfur compound. Illustrative examples of preferable organic sulfur compound include monosubstitution such as diphenyl disulfide, bis(4-chlorophenyl)disulfide, bis(3-chlorophenyl)disulfide, bis(4-bromophenyl)disulfide, bis (3-bromophenyl)disulfide, bis(4-fluorophenyl)disulfide, bis(4-iodophenyl)disulfide and bis(4-cyanophenyl)disulfide; disubstitution such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide and bis(2-cyano-5-bromophenyl)disulfide; trisubstitution such as bis(2,4,6-trichlorophenyl)disulfide and bis(2-cyano-4-chloro-6-bromophenyl)disulfide; tetrasubstitution such as bis(2,3,5,6-tetrachlorophenyl)disulfide; and pentasubstitution such as bis(2,3,4,5,6-pentachlorophenyl)disulfide and bis(2,3,4,5,6-pentabromophenyl)disulfide. The organic sulfur compound contributes to resilience performance. Particularly preferable organic sulfur compound is diphenyl disulfide and bis(pentabromophenyl)disulfide.

In light of resilience performance of the golf ball 2, the amount of the organic sulfur compound to be blended is preferably equal to or greater than 0.1 part by weight and more preferably equal to or greater than 0.2 part by weight per 100 parts by weight of the base rubber. In light of the soft feel at impact, the amount of the organic sulfur compound to be blended is preferably equal to or less than 2.0 parts by weight, more preferably equal to or less than 1.5 parts by weight, still more preferably equal to or less than 1.0 part by weight, and particularly preferably equal to or less than 0.8 part by weight per 100 parts by weight of the base rubber.

A filler may be blended into the center 8 for the purpose of adjusting specific gravity and the like. Illustrative examples of suitable filler include zinc oxide, barium sulfate, calcium carbonate and magnesium carbonate. Also, powder consisting of a highly dense metal may be blended as a filler. Specific examples of the highly dense metal include tungsten and molybdenum. The amount of the filler to be blended is determined ad libitum so that intended specific gravity of the center 8 can be accomplished. Particularly preferable filler is zinc oxide. Zinc oxide serves not only in adjusting specific gravity but also as a crosslinking activator. Various kinds of additives such as sulfur, a sulfur compound, an anti-aging agent, a coloring agent, a plasticizer, a dispersant and the like may be blended in an appropriate amount to the center 8 as needed. The center 8 may be also blended with crosslinked rubber powder or synthetic resin powder.

It is preferred that the center 8 has a diameter of 30.0 mm or greater and 41.0 mm or less. The center 8 with a diameter of equal to or greater than 30.0 mm contributes to resilience performance. In this respect, the diameter is more preferably equal to or greater than 33.0 mm. By setting the diameter to be equal to or less than 41.0 mm, the mid layer 10 and the cover 6 can contribute to durability. In this respect, the diameter is more preferably equal to or less than 40.5 mm. The center 8 may have two or more layers.

It is preferred that the center 8 has an amount of compressive deformation C1 of 3.6 mm or greater and 5.0 mm or less. The center 8 having an amount of compressive deformation of equal to or greater than 3.6 mm contributes to soft feel at impact. In this respect, the amount of compressive deformation C1 is more preferably equal to or greater than 3.7 mm, and particularly preferably equal to or greater than 3.8 mm. The center 8 having an amount of compressive deformation C1 of equal to or less than 5.0 mm contributes to resilience performance and durability of the golf ball 2. In this respect, the amount of compressive deformation C1 is more preferably equal to or less than 4.9 mm, and particularly preferably equal to or less than 4.8 mm.

Upon measurement of the amount of compressive deformation, a sphere (i.e. center, core or golf ball) is first placed on a hard plate made of metal. Next, a cylinder made of metal gradually descends toward the sphere. The sphere intervened between the bottom face of the cylinder and the hard plate is deformed. A migration distance of the cylinder, starting from the state in which initial load of 98 N is applied to the sphere up to the state in which final load of 1274 N is applied thereto is the amount of compressive deformation.

A surface hardness of the center 8 is preferably 45 or greater and 65 or less. The center 8 having a surface hardness of equal to or greater than 45 contributes to resilience performance. In this respect, the surface hardness is more preferably equal to or greater than 47, and particularly equal to or greater than 50. The center 8 having a surface hardness of equal to or less than 65 contributes to feel at impact. Further, the center 8 having a surface hardness of equal to or less than 65 also contributes to reduction of spin. In this respect, the surface hardness is more preferably equal to or less than 63, and particularly preferably equal to or less than 60. The surface hardness is measured by an automated rubber hardness measurement machine (trade name "LA1", available from Koubunshi Keiki Co., Ltd.) which is equipped with a Shore D type spring hardness scale, being pressed to the surface of the center 8.

It is preferred that the center 8 has a weight of 25 g or greater and 42 g or less. Crosslinking temperature of the center 8 is usually 140° C. or greater and 180° C. or less. The crosslinking time period of the center 8 is usually 10 minutes or longer and 60 minutes or less. The center may be formed by two or more layers.

The mid layer 10 comprises a resin composition. Preferable base resin for the resin composition is a styrene block-containing thermoplastic elastomer and an ionomer resin. The styrene block-containing thermoplastic elastomer contributes to feel at impact of the golf ball 2. The ionomer resin contributes to resilience performance of the golf ball 2. It is preferred that the styrene block-containing thermoplastic elastomer and the ionomer resin are used in combination.

The styrene block-containing thermoplastic elastomer includes a polystyrene block as a hard segment and a soft segment. Typical soft segment is a diene block. Examples of the styrene block-containing thermoplastic elastomer include styrene-butadiene-styrene block copolymers (SBS), styrene-isoprene-styrene block copolymers (SIS), styrene-isoprene-butadiene-styrene block copolymers (SIBS) hydrogenated SBS, hydrogenated SIS and hydrogenated SIBS. Exemplary hydrogenated SBS may include styrene-ethylene-butylene-styrene block copolymers (SEBS) Exemplary hydrogenated SIS may include styrene-ethylene-propylene-styrene block copolymers (SEPS) Exemplary hydrogenated SIBS may include styrene-ethylene-ethylene-propylene-styrene block copolymers (SEEPS).

In light of resilience performance of the golf ball 2, content of the styrene component in the thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, exemplary styrene block-containing thermoplastic elastomer may include alloys of olefin and one or two or more selected from the group consisting of SBS, SIS, SIBS, SEBS, SEPS and SEEPS, and hydrogenated products thereof. Olefin component in the alloy is presumed to contribute to the improvement of compatibility with other base polymers. Use of this alloy may improve resilience performance of the golf ball 2. Preferably, an olefin having 2 to 10 carbon atoms may be used. Illustrative examples of suitable olefin include ethylene, propylene, butane and pentene. Ethylene and propylene are particularly preferable.

Specific examples of polymer alloys include "Rabalon® T3221C", "Rabalon® T3339C", "Rabalon® SJ4400N", "Rabalon® SJ5400N", "Rabalon® SJ6400N", "Rabalon® SJ7400N", "Rabalon® SJ8400N", "Rabalon® SJ9400N" and "Rabalon® SR04", trade names by Mitsubishi Chemical Corporation. Other specific examples of the styrene block-containing thermoplastic elastomer include "Epofriend® A1010", a trade name by Daicel Chemical Industries; and "Septon HG-252", a trade name by Kuraray Co., Ltd.

In light of feel at impact, a material hardness of the styrene block-containing thermoplastic elastomer is preferably less than 8, more preferably less than 6, and particularly preferably less than 5. Upon measurement of the material hardness, a slab comprising the styrene block-containing thermoplastic elastomer is used. In the present invention, unless there is any specific note, the hardness is measured by an automated rubber hardness measurement machine (trade name "LA1", available from Koubunshi Keiki Co., Ltd.) which is equipped with a Shore D type spring hardness scale in accordance with a standard of "ASTM-D 2240-68". For the measurement, a slab which is formed by hot press and having a thickness of about 2 mm is used. Prior to the measurement, the slab is stored at a temperature of 23° C. for two weeks. When the measurement is carried out, three slabs are overlaid. Upon measurement of the material hardness of the styrene block-containing thermoplastic elastomer, a slab comprising only the styrene block-containing thermoplastic elastomer is used. In addition, the material hardness measured by a JIS-A type spring hardness scale is preferably less than 60, more preferably less than 40, and particularly preferably less than 30.

Examples of preferred ionomer resin include binary copolymers formed with α-olefin and an α,β-unsaturated carboxylic acid having 3 to 8 carbon atoms. Other preferable examples of the other ionomer resin include ternary copolymers formed with α-olefin, an α,β-unsaturated carboxylic acid having 3 to 8 carbon atoms and an α,β-unsaturated carboxylate ester having 2 to 22 carbon atoms. In the binary copolymer and ternary copolymer, preferable α-olefin may be ethylene and propylene, while preferable α,β-unsaturated carboxylic acid may be acrylic acid and methacrylic acid. In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of resilience performance and durability of the golf ball 2 is sodium ion, zinc ion, lithium ion and magnesium ion.

Preferable binary copolymer comprises 80% by weight or more and 90% by weight or less α-olefin, and 10% by weight or more and 20% by weight or less α,β-unsaturated carboxylic acid. This binary copolymer provides excellent resilience performance. Preferable ternary copolymer comprises 70% by weight or more and 85% by weight or less α-olefin, 5% by weight or more and 30% by weight or less α,β-unsaturated carboxylic acid, and 1% by weight or more and 25% by weight or less α,β-unsaturated carboxylate ester. This ternary copolymer provides excellent resilience performance. Particularly preferable ionomer resin is a copolymer formed with ethylene, and acrylic acid or methacrylic acid.

Specific examples of the ionomer resin include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318" and "Himilan MK7320", available from Dupont-MITSUI POLYCHEMICALS Co., Ltd.; trade names; "Surlyn® 6120", "Surlyn® 6910", "Surlyn® 7930", "Surlyn® 7940", "Surlyn® 8140", "Surlyn® 8150", "Surlyn® 8940", "Surlyn® 8945", "Surlyn® 9120", "Surlyn® 9150", "Surlyn® 9910", "Surlyn® 9945" and "Surlyn® AD8546", available from Dupont; and trade names "IOTEK 7010", "IOTEK 7030", "IOTEK 7510", "IOTEK 7520", "IOTEK 8000" and "IOTEK 8030", available from ExxonMobil Chemical Company. Two or more kinds of the ionomer resin may be used in combination. An ionomer resin neutralized with a monovalent metal ion, and an ionomer resin neutralized with a bivalent metal ion may be used in combination.

In light of resilience performance, the material hardness of the ionomer resin is preferably equal to or greater than 50, more preferably equal to or greater than 53, and particularly preferably equal to or greater than 55. In light of feel at impact, the material hardness of the ionomer resin is preferably equal to or less than 70, more preferably equal to or less than 67, and particularly preferably equal to or less than 65. Upon measurement of the material hardness of the ionomer resin, a slab comprising only ionomer resin is used.

When the styrene block-containing thermoplastic elastomer and the ionomer resin are used in combination, a proportion of the styrene block-containing thermoplastic elastomer to the total base resin is preferably 20% by weight or greater and 60% by weight or less. By setting the proportion to be equal to or greater than 20% by weight, favorable feel at impact is obtained. In this respect, the proportion is more preferably equal to or greater than 25% by weight, and particularly preferably equal to or greater than 30% by weight. The mid layer 10 having the proportion of equal to or less than 60% by weight does not deteriorate resilience performance. In this respect, the proportion is more preferably equal to or less than 55% by weight and particularly equal to or less than 50% by weight.

When the styrene block-containing thermoplastic elastomer and the ionomer resin are used in combination, a proportion of the ionomer resin to the total base resin is preferably 40% by weight or greater and 80% by weight or less. By setting the proportion to be equal to or greater than 40% by weight, favorable resilience performance is obtained. In this respect, the proportion is more preferably equal to or greater than 45% by weight, and particularly preferably equal to or greater than 50% by weight. The mid layer 10 having the proportion of equal to or less than 80% by weight does not deteriorate feel at impact. In this respect, the proportion is more preferably equal to or less than 75% by weight, and particularly equal to or less than 70% by weight.

When the styrene block-containing thermoplastic elastomer and the ionomer resin are used in combination, a proportion of the summation of the styrene block-containing thermoplastic elastomer and the ionomer resin to the total base resin is preferably 90% by weight or greater. The proportion is ideally 100% by weight.

Other resin may be used in the mid layer 10 together with the styrene block-containing thermoplastic elastomer or the ionomer resin. Illustrative examples of the other resin include thermoplastic polyester elastomers, thermoplastic polyamide elastomers, thermoplastic polyurethane elastomers and thermoplastic polyolefin elastomers.

The resin composition in the mid layer 10 contains a metal oxide with a three-dimensional shape. This metal oxide has three or more needle-like parts. The three-dimensional shape means a shape in which a plane including an axis of a first needle-like part and an axis of a second needle-like part, does not include an axis of a third needle-like part.

Figure 2:
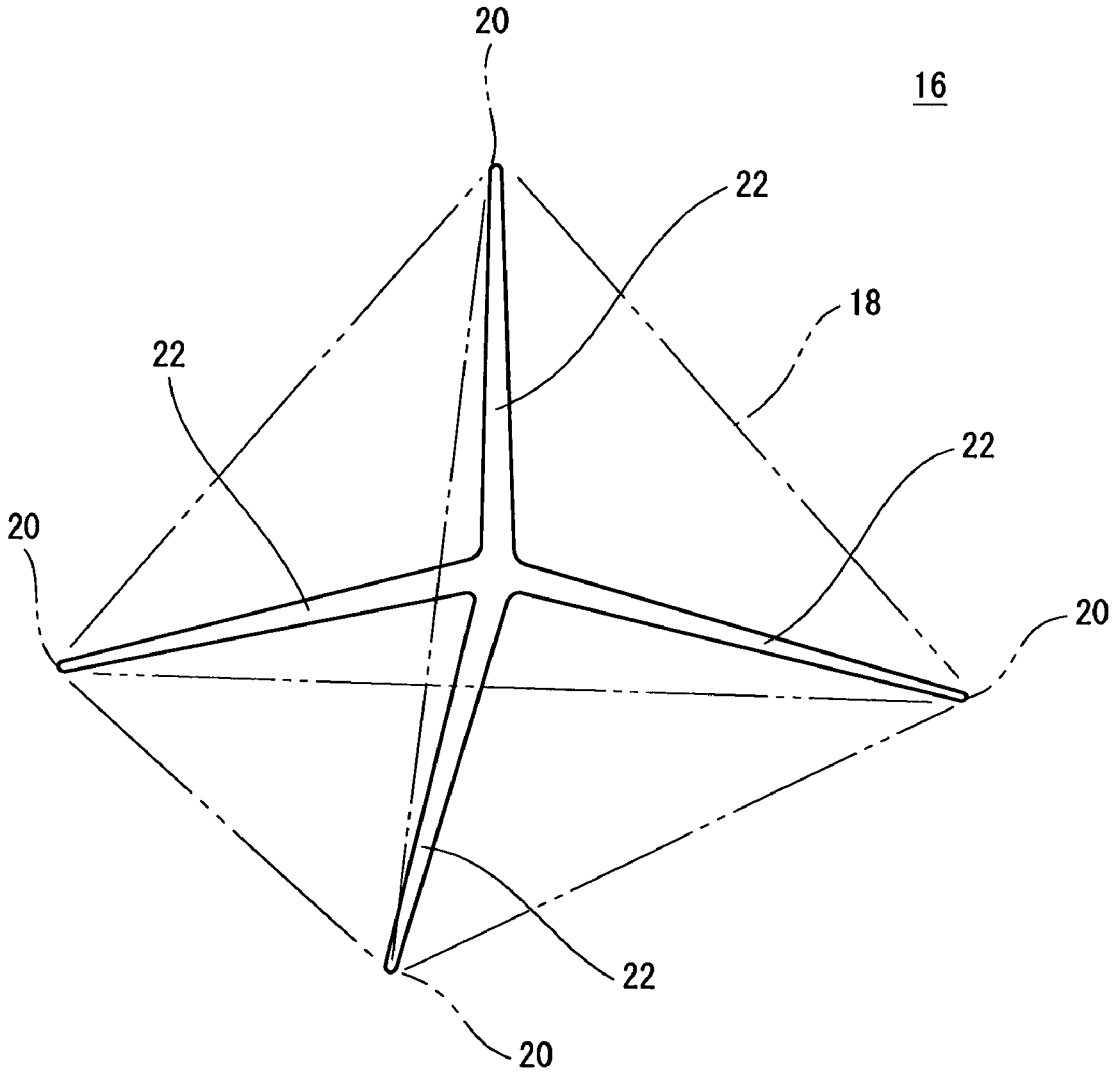
FIG. 2 is a perspective view illustrating a metal oxide blended in a mid layer of the golf ball shown in FIG. 1.

In FIG. 2, a favorable metal oxide 16 is depicted. This metal oxide 16 has four needle-like parts 22, each having one of four apices 20 of a triangular pyramid 18 as an end. Another end of all the four needle-like parts 22 is positioned at a point existing inside of the triangular pyramid. From the point, four axes extend to the four apices 20 of the triangular pyramid. The metal oxide 16 has a similar shape to a Tetrapod (registered trademark). Preferably, the metal oxide 16 is needle-like crystal. Preferably, the triangular pyramid 18 is a regular tetrahedron and the other ends of the needle-like parts 22 are positioned at the center of the regular tetrahedron. A length of the four needle-like parts 22 is substantially the same.

Illustrative examples of the metal oxide 16 which can have a three-dimensional shape include zinc oxide, titanium oxide, barium sulfate and talc. Preferable metal oxide 16 is zinc oxide. Specific examples of preferable metal oxide 16 includes zinc oxide available from MATSUSHITA ELECTRONIC INDUSTRIAL CO., LTD. (trade name "Panatetra®". This zinc oxide has a shape shown in FIG. 2.

When the metal oxide 16 with a three-dimensional shape is dispersed in the base resin, the mid layer 10 is reinforced. When molding the mid layer 10, the resin composition flows. Especially when molding the mid layer with injection molding, the resin composition flows remarkably. When the metal oxide 16 has a three-dimensional shape, the metal oxide 16 is not oriented even if the resin composition flows. In this mid layer 10, durability is not deteriorated by the orientation. The mid layer 10 contributes to durability of the golf ball 2. When the cover 6 or the mid layer 10 is thin, the golf ball 2 is easily damaged by being hit repeatedly. When the metal oxide 16 with a three-dimensional shape is dispersed in the mid layer 10, the damage is restricted even if the cover 6 or the mid layer 10 of the golf ball 2 is thin.

A mean length of the needle-like parts 22 of the metal oxide 16 is preferably 5 μm or greater and 50 μm or less. The metal oxide 16 with the mean length of equal to or greater than 5 μm contributes to rigidity of the mid layer 10. In this respect, the mean length is more preferably equal to or greater than 7 μm. The metal oxide 16 with the mean length of equal to or less than 50 μm contributes to dispersibility. In this respect, the mean length is particularly preferably equal to or less than 40 μm.

When the amount of the metal oxide 16 to be blended is too small, a reinforcing effect is insufficient and durability is insufficient. When the amount to be blended is too large, durability is also insufficient due to brittleness of the mid layer 10. In light of durability, the amount of the metal oxide 16 with a three-dimensional shape to be blended is preferably equal to or greater than 0.3 part by weight, more preferably equal to or greater than 0.5 part by weight, and particularly preferably equal to or greater than 5 parts by weight per 100 parts by weight of the base resin. In light of durability, the amount is preferably equal to or less than 20 parts by weight, more preferably equal to or less than 17, and particularly preferably equal to or less than 15 parts by weight.

When general fillers are blended, rigidity of the mid layer 10 is enhanced and at the same time hardness of the mid layer 10 is also enhanced. Increase of rigidity contributes to resilience performance. On the other hand, feel at impact is deteriorated by the increase of rigidity. Because the metal oxide 16 with a three-dimensional shape has a great reinforcing effect, rigidity is sufficiently increased by blending the metal oxide 16. Even if the amount of the metal oxide 16 is small, great resilience performance is obtained. The small amount does not greatly increase the hardness of the mid layer 10. By blending this metal oxide 16, both of resilience performance and feel at impact are achieved. The low hardness contributes to reduction of the spin.

A ratio R which is calculated by the following formula (V) is preferably equal to or greater than 1.05.

$$R=((Ym/Xm)/(Yo/Xo)) \quad \text{(V)}$$

In the formula (V), Ym represents flexural rigidity (MPa) of resin composition of the mid layer 10, Xm represents a D hardness of the resin composition, Yo represents flexural rigidity (MPa) of the base resin of the mid layer 10, and Xo represents a D hardness of the base resin. Upon measurement of the hardness Xm and the flexural rigidity Ym, a slab comprising the same resin composition as the resin composition of the mid layer 10. Upon measurement of the hardness Xo and the flexural rigidity Yo, a slab comprising the base resin which is used for the mid layer 10. When two or more base resins are used in combination in the mid layer 10, a slab comprising a blend of these resins is used. The mid layer 10 having the ratio R of equal to or greater than 1.05 contributes to high resilience performance and soft feel at impact. In this respect, the ratio is preferably equal to or greater than 1.06, and particularly preferably equal to or greater than 1.07. The ratio R is preferably equal to or less than 1.30.

The mid layer 10 has a D hardness Xm of 32 or greater and 39 or less. The mid layer 10 having a D hardness of equal to or greater than 32 does not deteriorate resilience performance. In this respect, the D hardness is more preferably equal to or greater than 33, and particularly preferably equal to or greater than 34. The mid layer 10 having a D hardness of equal to or less than 39 contributes to soft feel at impact. Further, the mid layer 10 having a D hardness of equal to or less than 39 reduce spin. In this respect, the D hardness is more preferably equal to or less than 38.

In light of resilience performance, flexural rigidity Ym of the mid layer 10 is preferably equal to or greater than 30 MPa, more preferably equal to or greater than 35 MPa, and particularly preferably equal to or greater than 60 MPa. The flexural rigidity is measured in accordance with a standard of "JIS K7106". Upon measurement, as mentioned above, the slab comprising the same resin composition as the resin composition of the mid layer 10. This slab is obtained by hot press. The slab has a thickness of 2 mm. The slab which is stored at a temperature of 23° C. for two weeks is used for the measurement.

It is preferred that the mid layer 10 has a thickness of 0.6 mm or greater and 1.4 mm or less. The mid layer 10 having a thickness Tm of equal to or greater than 0.6 mm contributes to soft feel at impact. In this respect, the thickness Tm is more preferably equal to or greater than 0.7 mm, and particularly preferably equal to or greater than 0.8 mm. The mid layer 10 having a thickness Tm of equal to or less than 1.4 mm does not deteriorate resilience performance. In this respect, the thickness Tm is more preferably equal to or less than 1.2 mm, and particularly preferably equal to or less than 1.0 mm.

Into the resin composition of the mid layer 10 may be blended a filler for the purpose of adjusting specific gravity and the like. Illustrative examples of suitable filler include zinc oxide, barium sulfate, calcium carbonate and magnesium carbonate. Powder of a highly dense metal may be also blended as a filler. Specific examples of the highly dense metal include tungsten and molybdenum. The amount of the filler to be blended is determined ad libitum so that the intended specific gravity of the mid layer 10 can be accomplished. Into the mid layer 10 may be also blended a coloring agent, crosslinked rubber powder or synthetic resin powder.

The cover 6 comprises a resin composition. The preferable base resin for the resin composition is an ionomer resin. An ionomer resin which is equal to the ionomer resin in the mid layer 10 is used for the cover 6. The ionomer resin contributes to resilience performance of the golf ball 2. For the cover 6, styrene block-containing thermoplastic elastomers, thermoplastic polyester elastomers, thermoplastic polyamide elastomers, thermoplastic polyurethane elastomers or thermoplastic polyolefin elastomers may be used. Other resin may be used together with the ionomer resin. When the other resin is used in combination with the ionomer resin, it is preferred the ionomer resin is a principal component, in light of resilience performance. Proportion of the ionomer resin in total amount of the base resin is preferably equal to or greater than 70 parts by weight and preferably equal to or less than 80 parts by weight.

A D hardness of the cover 6 is preferably equal to or greater than 57. The cover 6 contributes to resilience performance. In light of resilience performance, the D hardness is more preferably equal to or greater than 58, and particularly preferably equal to or greater than 59. In light of feel at impact, the D hardness is preferably equal to or less than 70 and more preferably equal to or less than 67. Upon measurement of the D hardness, a slab comprising the same resin composition as the resin composition of the cover 6. Details of the measurement are as mentioned above.

A thickness of the cover 6 is preferably 0.3 mm or greater and 1.6 mm or less. The cover 6 having a thickness of equal to or greater than 0.3 mm contributes to flight performance and durability. In this respect, the thickness is more preferably equal to or greater than 0.5 mm. The cover 6 having a thickness of equal to or less than 1.6 mm does not deteriorate feel at impact and resilience performance. In this respect, the thickness is more preferably equal to or less than 1.5 mm, and particularly preferably equal to or less than 1.3 mm. The cover may have two or more layers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Powder of a highly dense metal such as tungsten, molybdenum or the like may be also blended into the cover 6 for the purpose of adjusting the specific gravity.

An amount of compressive deformation C3 of the golf ball 2 is preferably 3.2 mm or greater and 3.8 mm or less. The golf ball 2 having an amount of compressive deformation C3 of equal to or greater than 3.2 mm is excellent in feel at impact. In this respect, the amount of compressive deformation C3 is more preferably equal to or greater than 3.3 mm, and particularly preferably equal to or greater than 3.4 mm. The golf ball 2 having an amount of compressive deformation C3 of equal to or less than 3.8 mm is excellent in durability. In this respect, the amount of compressive deformation C3 is more preferably equal to or less than 3.7 mm.

A ratio of the amount of compressive deformation C1 of the center 8 to the amount of compressive deformation C2 of the core 4, (C1/C2), is preferably less than 1.09. The golf ball 2 of which the ratio of the amount of compressive deformation (C1/C2) is within the above range has a relatively soft mid layer. This golf ball 2 is excellent in feel at impact. In light of feel at impact, the ratio (C1/C2) is more preferably less than 1.08. The ratio (C1/C2) is preferably equal to or greater than 1.03. In addition, the amount of compressive deformation C2 of the core 4 is preferably 3.4 mm or greater and 4.8 mm or less.

A ratio of the amount of compressive deformation C1 of the center 8 to the amount of compressive deformation C3 of the golf ball 2, (C1/C3), is preferably greater than 1.18. In the golf ball 2 of which the ratio of the amount of compressive deformation (C1/C3) is within the above range, an energy caused by hitting is sufficiently transmitted to the center 8. Further, the golf ball 2 of which the ratio (C1/C3) is within the above range is excellent in feel at impact. In this respect, the ratio (C1/C3) is more preferably equal to or greater than 1.19, and particularly preferably equal to or greater than 1.20.

Figure 3:
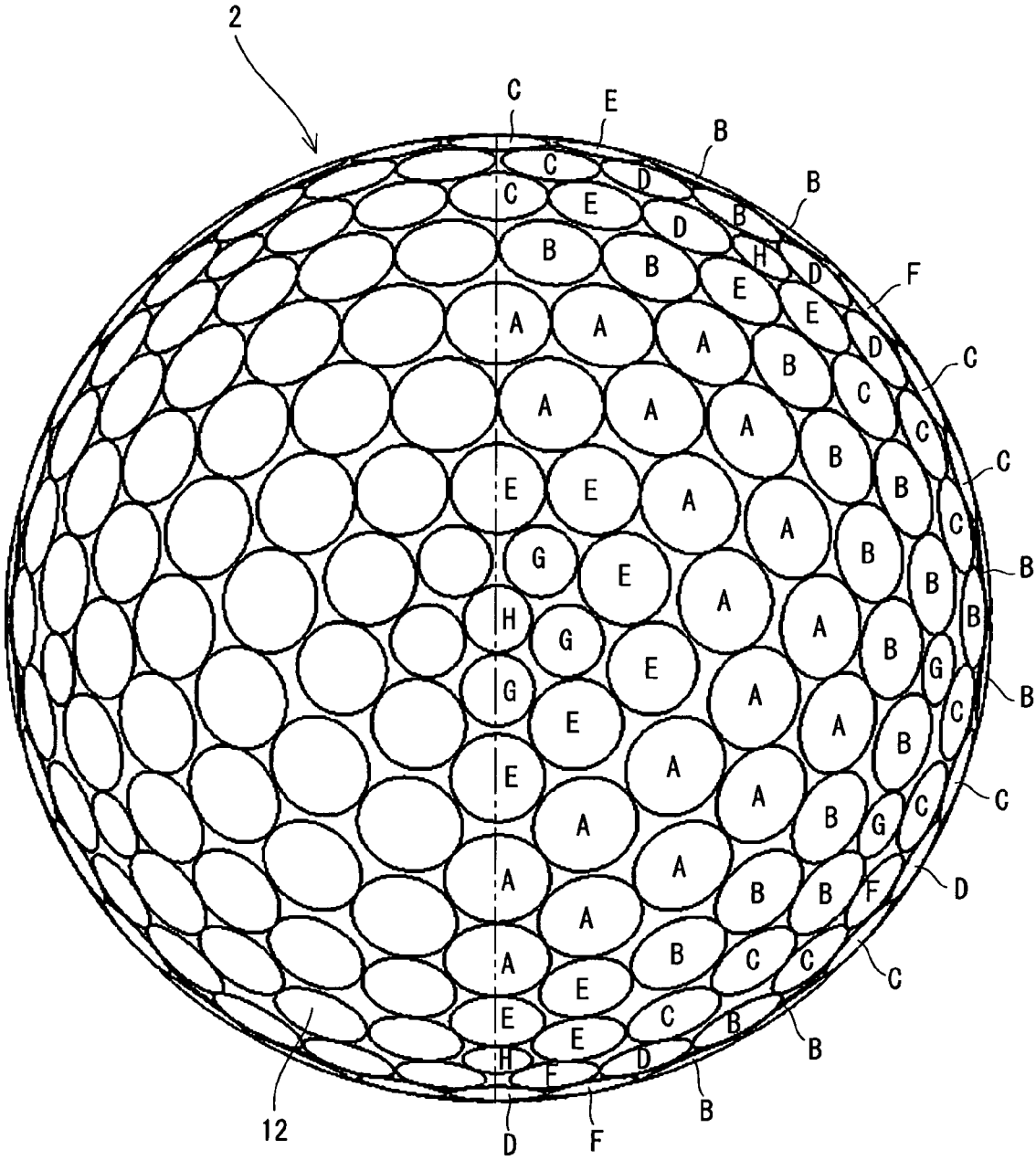
FIG. 3 is an enlarged plan view illustrating the golf ball shown in FIG. 1.

FIG. 3 is an enlarged plan view illustrating the golf ball 2 shown in FIG. 1. In FIG. 3, kinds of dimples 12 are depicted with symbols A to H in one unit, provided when the surface of the golf ball 2 is comparted into 4 units. This golf ball 2 has dimples A having a diameter of 4.60 mm, dimples B having a diameter of 4.45 mm, dimples C having a diameter of 4.30 mm, dimples D having a diameter of 4.20 mm, dimples E having a diameter of 4.10 mm, dimples F having a diameter of 3.90 mm, dimples G having a diameter of 3.20 mm, and dimples H having a diameter of 3.00 mm. The number of the dimples A is 70; the number of the dimples B is 88; the number of the dimples C is 56; the number of the dimples D is 26; the number of the dimples E is 42; the number of the dimples F is 20; the number of the dimples G is 18; and the number of the dimples H is 8. Total number of the dimples 12 is 328.

Figure 4:
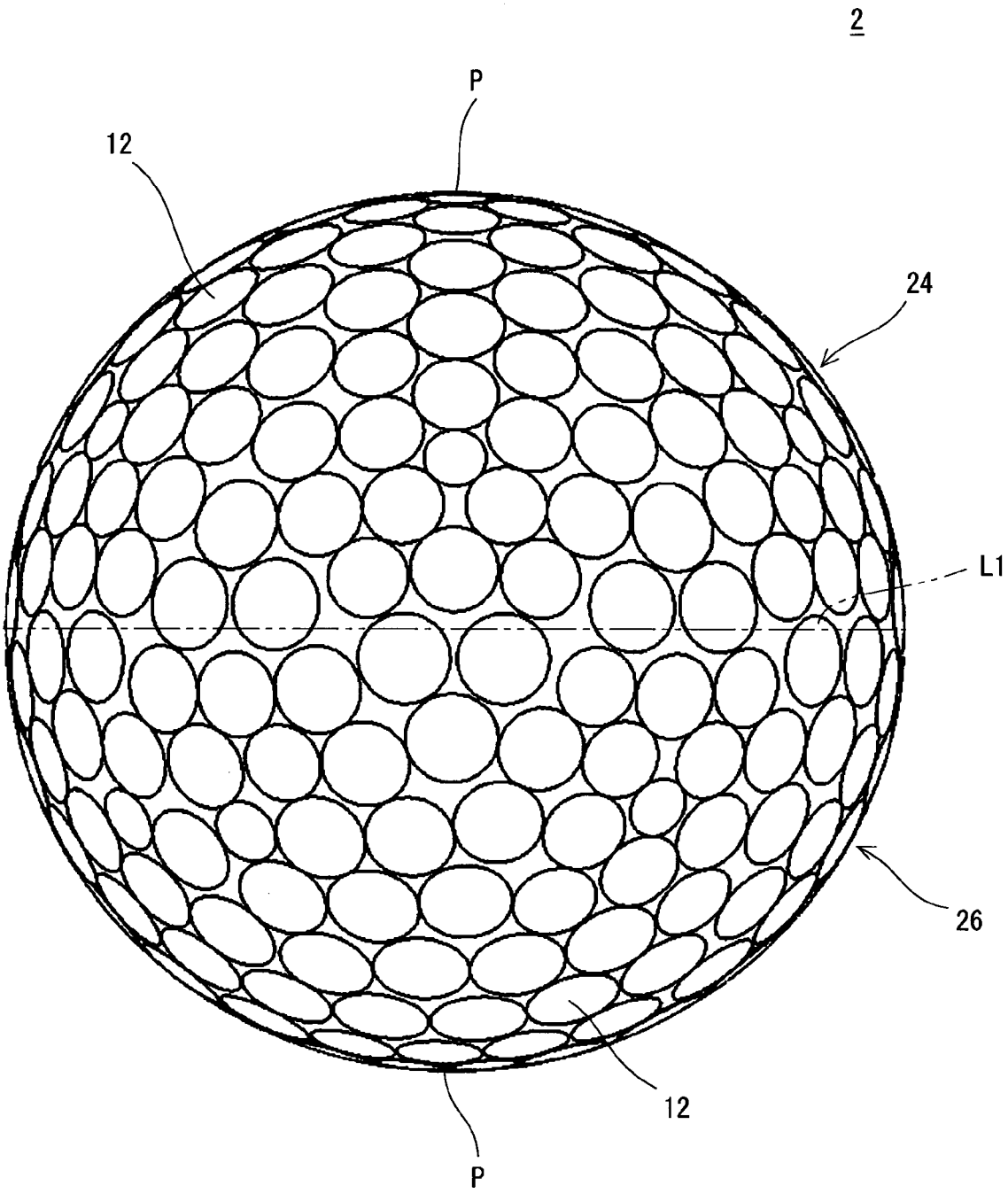
FIG. 4 is a front view illustrating the golf ball shown in FIG. 3.

FIG. 4 is a front view illustrating the golf ball 2 shown in FIG. 3. In FIG. 4, a first latitude line L1 is depicted. The first latitude line L1 has latitude of 0 degree. The first latitude line L1 is also the equator line. As is clear from FIG. 4, the first latitude line L1 intersects the dimples 12. This golf ball 2 is obtained by a mold with a parting line between an upper mold half and a lower mold half being zigzag. Intersection of the first latitude line L1 and the dimples enhances the dimple effect in the vicinity of the equator. The first latitude line L1 may not intersect the dimples 12. The surface of the golf ball 2 is comparted into a northern hemisphere 24 and a southern hemisphere 26 by the latitude line L1 as a boundary. In FIG. 4, a symbol P indicates poles. A direction from one pole P to another pole P is an opening and closing direction of the mold.

Figure 5:
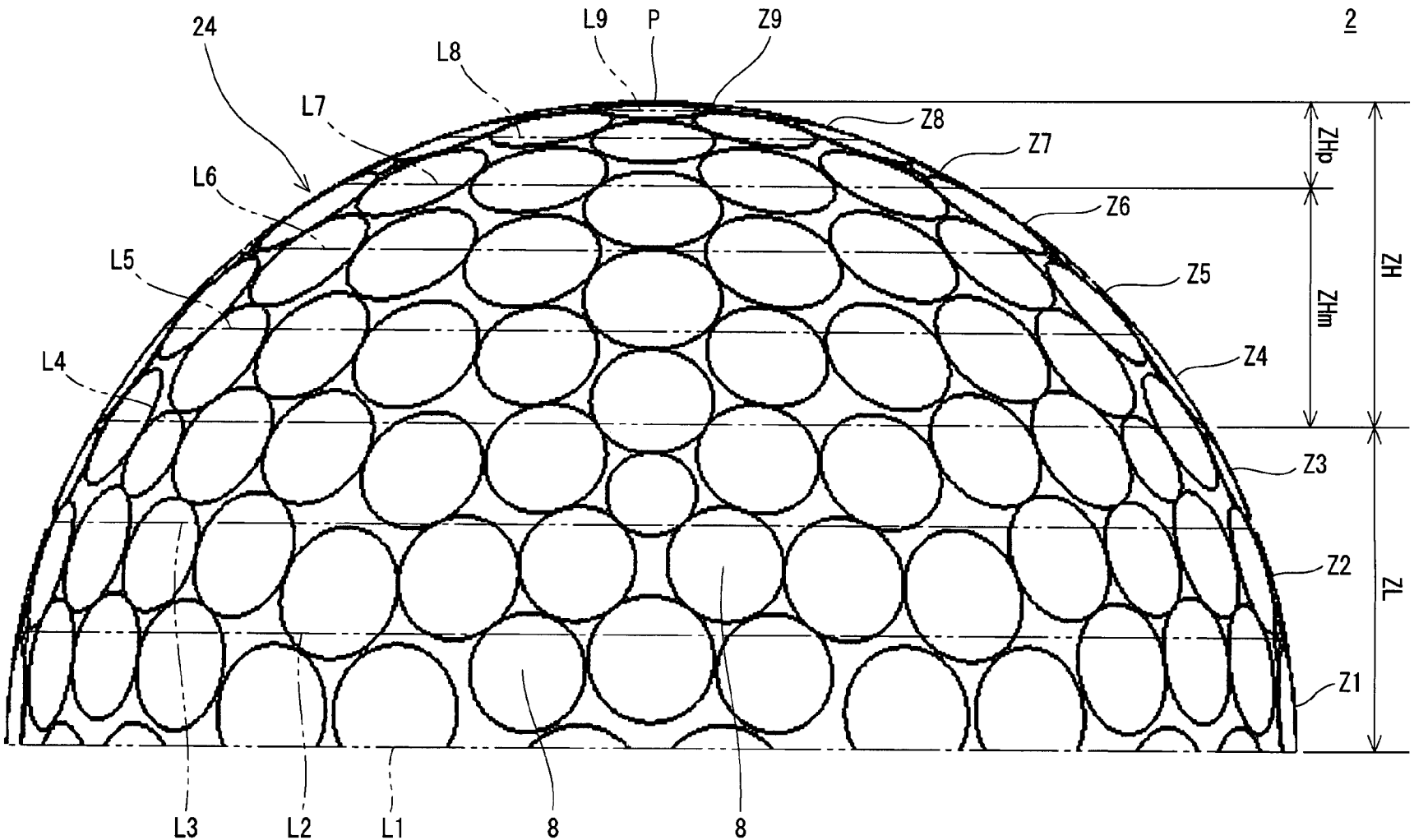
FIG. 5 is an enlarged view illustrating a part of a golf ball shown in FIG. 4.

FIG. 5 is an enlarged view illustrating a part of a golf ball 2 shown in FIG. 4. In FIG. 5, the northern hemisphere 24 is depicted. In FIG. 5, the first latitude line L1, a second latitude line L2,a third latitude line L3, a fourth latitude line L4, a fifth latitude line L5, a sixth latitude line L6, a seventh latitude line L7, a eighth latitude line L8 and a ninth latitude line L9 are depicted. The first latitude line L1 has latitude of 0 degree, the second latitude line L2 has latitude of 10 degrees, the third latitude line L3 has latitude of 20 degrees, the fourth latitude line L4 has latitude of 30 degrees, the fifth latitude line L5 has latitude of 40 degrees, the sixth latitude line L6 has latitude of 50 degrees, the seventh latitude line L7 has latitude of 60 degrees, the eighth latitude line L8 has latitude of 70 degrees and the ninth latitude line L9 has latitude of 80 degrees.

A region between the first latitude line L1 and the second latitude line L2 is a first region Z1. The first region Z1 does not include a portion on the second latitude line L2. The latitude of the first region Z1 is 0 degree or greater and less than 10 degrees. A region between the second latitude line L2 and the third latitude line L3 is a second region Z2. The second region Z2 does not include a portion on the third latitude line L3. The latitude of the second region Z2 is 10 degrees or greater and less than 20 degrees. A region between the third latitude line L3 and the fourth latitude line L4 is a third region Z3. The third region Z3 does not include a portion on the fourth latitude line L4. The latitude of the third region Z3 is 20 degrees or greater and less than 30 degrees. A region between the fourth latitude line L4 and the fifth latitude line L5 is a fourth region Z4. The fourth region Z4 does not include a portion on the fifth latitude line L5. The latitude of the fourth region Z4 is 30 degrees or greater and less than 40 degrees. A region between the fifth latitude line L5 and the sixth latitude line L6 is a fifth region Z5. The fifth region Z5 does not include a portion on the sixth latitude line L6. The latitude of the fifth region Z5 is 40 degrees or greater and less than 50 degrees. A region between the sixth latitude line L6 and the seventh latitude line L7 is a sixth region Z6. The sixth region Z6 does not include a portion on the seventh latitude line L7. The latitude of the sixth region Z6 is 50 degrees or greater and less than 60 degrees. A region between the seventh latitude line L7 and the eighth latitude line L8 is a seventh region Z7. The seventh region Z7 does not include a portion on the eighth latitude line L8. The latitude of the seventh region Z7 is 60 degrees or greater and less than 70 degrees. A region between the eighth latitude line L8 and the ninth latitude line L9 is an eighth region Z8. The eighth region Z8 does not include a portion on the ninth latitude line L9. The latitude of the eighth region Z8 is 70 degrees or greater and less than 80 degrees. A region enclosed by the ninth latitude line L9 is a ninth region Z9. The latitude of the ninth region Z9 is 80 degrees or greater and 90 degrees or less. The southern hemisphere 26 has the first to the ninth regions in the same manner as the northern hemisphere 24, which is not shown.

The northern hemisphere 24 is comparted into a low latitude region ZL and a high latitude region ZH. A compartment line between the low latitude region ZL and the high latitude region ZH is the fourth latitude line L4. The low latitude region ZL includes the first region Z1, the second region Z2 and the third region Z3. The latitude of the low latitude region ZL is 0 degree or greater and less than 30 degrees. The high latitude region ZH includes the fourth region Z4, the fifth region Z5, the sixth region Z6, the seventh region Z7, the eighth region Z8 and the ninth region Z9. The latitude of the high latitude region ZH is 30 degrees or greater and 90 degrees or less. On a phantom sphere, the surface area of the low latitude region ZL is equal to that of the high latitude region ZH. The southern hemisphere 26 also has the low latitude region ZL and the high latitude region ZH in the same manner as the northern hemisphere 24, which is not shown.

The high latitude region ZH is comparted into a middle region ZHm and a polar region ZHp. A compartment line between the middle region ZHm and the polar region ZHp is the seventh latitude line L7. The middle region ZHm includes the fourth region Z4, the fifth region Z5 and the sixth region Z6. The latitude of the middle region ZHm is 30 degrees or greater and less than 60 degrees. The polar region ZHp includes the seventh region Z7, the eighth region Z8 and the ninth region Z9. The latitude of the polar region ZHp is 60 degrees or greater and 90 degrees or less. The southern hemisphere 14 also has the middle region ZHm and the polar region ZHp in the same manner as the northern hemisphere 12, which is not shown.

Figure 6:
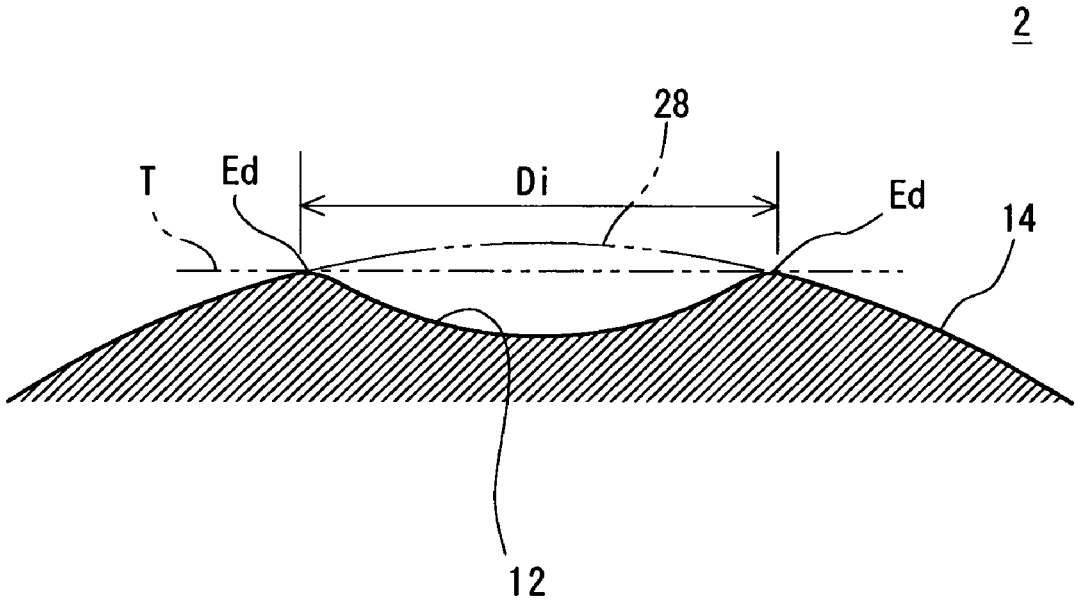
FIG. 6 is an enlarged cross-sectional view illustrating a part of the golf ball shown in FIG. 1.

FIG. 6 is an enlarged cross-sectional view illustrating a part of the golf ball 2 shown in FIG. 1. In FIG. 6, a cross-section along a plane traversing the deepest portion of the dimple 12 and the center of the golf ball 2 is depicted. Vertical direction in FIG. 6 is in-depth direction of the dimple 12. What is indicated by a chain double-dashed line 28 in FIG. 6 is a phantom sphere. The dimple 12 is recessed from the phantom sphere 28. The land 14 agrees with the phantom sphere 28.

What is indicated by a both-sided arrowhead Di in FIG. 6 is a diameter of the dimple 12. This diameter Di is a distance between one contact point Ed and another contact point Ed, provided when a common tangent line T to both sides of the dimple 12 is depicted. The contact point Ed is also an edge of the dimple 12. The edge Ed defines the contour of the dimple 12. When it is a noncircular dimple, a circle having the same area as the contour of the noncircular dimple has is assumed, and the diameter of the circle is considered as the diameter of the noncircular dimple.

The following is a definition of the number of kinds of the dimples 12.

N1: the number of kinds of the dimples 12 which are located in the first region Z1 and have a diameter of 3.40 mm or greater N2: the number of kinds of the dimples 12 which are located in the second region Z2 and have a diameter of 3.40 mm or greater N3: the number of kinds of the dimples 12 which are located in the third region Z3 and have a diameter of 3.40 mm or greater N4: the number of kinds of the dimples 12 which are located in the fourth region Z4 and have a diameter of 3.40 mm or greater N5: the number of kinds of the dimples 12 which are located in the fifth region Z5 and have a diameter of 3.40 mm or greater N6: the number of kinds of the dimples 12 which are located in the sixth region Z6 and have a diameter of 3.40 mm or greater N7: the number of kinds of the dimples 12 which are located in the seventh region Z7 and have a diameter of 3.40 mm or greater N8: the number of kinds of the dimples 12 which are located in the eighth region Z8 and have a diameter of 3.40 mm or greater N9: the number of kinds of the dimples 12 which are located in the ninth region Z9 and have a diameter of 3.40 mm or greater NL: the number of kinds of the dimples 12 which are located in the low latitude region ZL and have a diameter of 3.40 mm or greater NH: the number of kinds of the dimples 12 which are located in the high latitude region ZH and have a diameter of 3.40 mm or greater NHm: the number of kinds of the dimples 12 which are located in the middle region ZHm and have a diameter of 3.40 mm or greater NHp: the number of kinds of the dimples 12 which are located in the polar region ZHp and have a diameter of 3.40 mm or greater When determining the number of kinds, the dimples 12 with a diameter of less than 3.40 mm are excluded. It is because the dimples 12 with a small diameter have a small influence on the dimple effect.

Each of the first region Z1 in the northern hemisphere 24 and the first region Z1 in the southern hemisphere 26 includes 12 dimples B, 9 dimples C, 3 dimples D and 6 dimples F. The number of kinds N1 in the first region Z1 is 4.

Each of the second region Z2 in the northern hemisphere 24 and the second region Z2 in the southern hemisphere 26 includes 6 dimples B, 12 dimples C, 8 dimples D and 4 dimples F. The number of kinds N2 in the second region Z2 is 4.

Each of the third region Z3 in the northern hemisphere 24 and the third region Z3 in the southern hemisphere 26 includes 6 dimples B, 7 dimples C, 2 dimples D, 6 dimples E, 4 dimples G and 3 dimples H. The number of kinds N3 in the third region Z3 is 4. When counting the number of kinds N3, the dimples G and the dimples H are excluded.

Each of the fourth region Z4 in the northern hemisphere 24 and the fourth region Z4 in the southern hemisphere 26 includes 20 dimples B and 5 dimples E. The number of kinds N4 in the fourth region Z4 is 2.

Each of the fifth region Z5 in the northern hemisphere 24 and the fifth region Z5 in the southern hemisphere 26 includes 15 dimples A. The number of kinds N5 in the fifth region Z5 is 1.

Each of the sixth region Z6 in the northern hemisphere 24 and the sixth region Z6 in the southern hemisphere 26 includes 10 dimples A. The number of kinds N6 in the sixth region Z6 is 1.

Each of the seventh region Z7 in the northern hemisphere 24 and the seventh region Z7 in the southern hemisphere 26 includes 10 dimples A. The number of kinds N7 in the seventh region Z7 is 1.

Each of the eighth region Z8 in the northern hemisphere 24 and the eighth region Z8 in the southern hemisphere 26 includes 10 dimples E. The number of kinds N8 in the eighth region Z8 is 1.

Each of the ninth region Z9 in the northern hemisphere 24 and the ninth region Z9 in the southern hemisphere 26 includes 5 dimples G and 1 dimple H. The number of kinds N9 in the ninth region Z9 is 0. When counting the number of kinds N9, the dimples G and the dimples H are excluded.

Each of the low latitude region ZL in the northern hemisphere 24 and the low latitude region ZL in the southern hemisphere 26 includes 24 dimples B, 28 dimples C, 13 dimples D, 6 dimples E, 10 dimples F, 4 dimples G and 3 dimples H. The number of kinds NL in the low latitude region ZL is 5. When counting the number of kinds NL, the dimples G and the dimples H are excluded.

Each of the high latitude region ZH in the northern hemisphere 24 and the high latitude region ZH in the southern hemisphere 26 includes 35 dimples A, 20 dimples B, 15 dimples E, 5 dimples H and 1 dimple G. The number of kinds NH in the high latitude region ZH is 3. When counting the number of kinds NH, the dimples G and the dimples H are excluded.

Each of the middle region ZHm in the northern hemisphere 24 and the middle region ZHm in the southern hemisphere 26 includes 25 dimples A, 20 dimples B and 5 dimples E. The number of kinds NHm in the middle region ZHm is 3.

Each of the polar region ZHp in the northern hemisphere 24 and the polar region ZHp in the southern hemisphere 26 includes 10 dimples A, 10 dimples E, 5 dimples G and 1 dimple H. The number of kinds NHp in the polar region ZHp is 2. When counting the number NHp of the kinds, the dimples G and the dimples H are excluded.

In the present invention, a belonging of the dimples 12 which are located crossing the boundary is determined depending on the position of the center (the area center of gravity) of the dimple 12. For example, the dimple 12 that intersects the second latitude line L2 and has a latitude of the center of 0 degree or greater and less than 10 degrees belongs to the first region Z1, not to the second region Z2.

The golf ball 2 meets the above mentioned formula (I). In other words, the number of kinds NL in the low latitude region ZL is equal to or greater than the number of kinds NH in the high latitude region ZH. The golf ball 2 meets the above mentioned formula (II). In other words, the number of kinds NL in the low latitude region ZL is greater than the number of kinds NHm in the middle region ZHm, and greater than the number of kinds NHp in the polar region ZHp. Further, the number of kinds NHm in the middle region ZHm is equal to or greater than the number of kinds NHp in the polar region ZHp. In the golf ball 2, the number of kinds is biased. In the golf ball 2, the number of kinds in the vicinity of the equator is great. In the vicinity of the equator, dimples tend to be arranged orderly. The orderly arrangement deteriorates the dimple effect. In the golf ball 2 according to the present invention, the dimples 12 are not easily arranged orderly because many kinds of the dimples 12 are arranged in the vicinity of the equator. Moreover, even when the centers of the dimples 12 on the golf ball 2 are aligned, their contours are not arranged orderly. Using many kinds of the dimples supplies the dimple effect in the vicinity of the equator. With the golf ball 2, a great flight distance is achieved. In the golf ball 2, the dimple effect achieved when a portion that has the fastest circumferential velocity of the backspin is on the equator, is equal to the dimple effect achieved in the other circumstances.

In light of the dimple effect, the difference (NL−NH) between the number of kinds NL and the number of kinds NH is more preferably equal to or greater than 1, and particularly preferably equal to or greater than 2. In the golf ball 2 shown in FIG. 3 to FIG. 5, the number of kinds NL is 5 and the number of kinds NH is 3. Accordingly, the difference (NL−NH) is 2.

In light of the dimple effect, the difference (NL−NHm) between the number of kinds NL and the number of kinds NHm is more preferably equal to or greater than 2. In the golf ball 2 shown in FIG. 3 to FIG. 5, the number of kinds NL is 5 and the number of kinds NHm is 3. Accordingly, the difference (NL−NHm) is 2.

In light of the dimple effect, the difference (NL−NHp) between the number of kinds NL and the number of kinds NHp is more preferably equal to or greater than 2, and particularly preferably equal to or greater than 3. In the golf ball 2 shown in FIG. 3 to FIG. 5, the number of kinds NL is 5 and the number of kinds NHp is 2. Accordingly, the difference (NL−NHp) is 3.

In light of the dimple effect, it is preferable that the golf ball 2 meets the following formula (III).

$$NL > NHm > NHp \quad \text{(III)}$$

In other words, the difference (NHm−NHp) between the number of kinds NHm and the number of kinds NHp is preferably equal to or greater than 1. In the golf ball 2 shown in FIG. 3 to FIG. 5, the number of kinds NHm is 3 and the number of kinds NHp is 2. Accordingly, the difference (NHm−NHp) is 1.

In light of the dimple effect, it is preferable that the golf ball 2 meets the following formula (IV).

$$N1 \geqq N2 \geqq N3 > N4 \geqq N5 \geqq N6 \geqq N7 \geqq N8 \geqq N9 \quad \text{(VI)}$$

In the golf ball 2 shown in FIG. 3 to FIG. 5, the number of kinds N1 is 4, the number of kinds N2 is 4, the number N3 of the kinds is 4, the number of kinds N4 is 2, the number of kinds N5 is 1, the number of kinds N6 is 1, the number of kinds is N7, the number of kinds N8 is 1 and the number of kinds N9 of 0. The golf ball 2 meets the following formula (VI).

$$N1 = N2 = N3 > N4 > N5 = N6 = N7 = N8 = N9 \quad \text{(VI)}$$

Accordingly, the golf ball 2 meets the above mentioned formula (IV). More preferably, the golf ball 2 meets the following formula (VII).

$$N1 \geqq N2 \geqq N3 > N4 \geqq N5 \geqq N6 > N7 \geqq N8 \geqq N9 \quad \text{(VII)}$$

In the low latitude region ZL, the number of the dimples 12 is 88. As the number of the dimples B in the low latitude region ZL is 24, a ratio of the dimples B in number is 27.3%. The number of the dimples C is 28 and a ratio of the dimples C in number is 31.8%. The number of the dimples D is 13 and a ratio of the dimples D in number is 14.8%. The number of the dimples E is 6 and a ratio of the dimples E in number is 6.8%. The number of the dimples F is 10 and a ratio of the dimples F in number is 11.4%. In light of the dimple effect, it is preferable that the ratio of the dimple 12 in number is equal to or greater than 5% in every kind when the dimples 12 are included in the low latitude region ZL and have a diameter of equal to or greater than 3.40 mm.

In the high latitude region ZH, the number of the dimples 12 is 76. As the number of the dimples A in the high latitude region ZH is 35, a ratio of the dimples A in number is 46.1%. The number of the dimples B is 20 and a ratio of the dimples B in number is 26.3%. The number of the dimples E is 15 and a ratio of the dimples E in number is 19.7%. In light of the dimple effect, it is preferable that the ratio of the number of the dimples 12 included in the high latitude region ZH and having a diameter of equal to or greater than 3.40 mm is equal to or greater than 5% in every kind.

In the middle region ZHm, the number of the dimples 12 is 50. As the number of the dimples A in the middle region ZHm is 25, a ratio of the dimples A in number is 50.0%. The number of the dimples B is 20 and a ratio of the dimple B in number is 40.0%. The number of the dimples E is 5 and a ratio of the dimples E in number is 10.0%. In light of the dimple effect, it is preferable that the ratio of the number of the dimples 12 included in the middle region ZHm and having a diameter of equal to or greater than 3.40 mm is equal to or greater than 5% in every kind.

In the polar region ZHp, the number of the dimples 12 is 26. As the number of the dimples A in the polar region ZHp is 10, a ratio of the dimples A in number is 38.5%. The number of the dimples E is 10 and a ratio of the dimples E in number is 38.5%. In light of the dimple effect, it is preferable that the ratio of the number of the dimples 12 included in the polar region ZHp and having a diameter of equal to or greater than 3.40 mm is equal to or greater than 5% in every kind.

When the dimples 12 which are in the low latitude region ZL and have a diameter of equal to or greater than 3.40 mm are arranged in decreasing order of the diameter, a ratio (Dx/Dn) of a mean diameter Dx of the dimples 12 ranked in the top 10% to a mean diameter Dn of the dimples 12 ranked in the bottom 10% is preferably equal to or greater than 1.10. By setting the ratio (Dx/Dn) to be equal to or greater than 1.10, a great dimple effect in the vicinity of the equator is achieved. In this respect, the ratio (Dx/Dn) is more preferably equal to or greater than 1.12, and particularly preferably equal to or greater than 1.14. The ratio (Dx/Dn) is preferably equal to or less than 1.80. In the golf ball 2 shown in FIG. 3 to FIG. 5, the low latitude region ZL has 24 dimples B and 10 dimples F. As the number of the dimples 12 having a diameter of equal to or greater than 3.40 mm in the low latitude region ZL is 81, 8 dimples B correspond to the dimples 12 in the top 10% and 8 dimples F correspond to the dimples 12 in the bottom 10%. Accordingly, the ratio (Dx/Dn) is 1.14.

From the standpoint that a sufficient dimple effect is achieved, the total number of the dimples 12 is preferably equal to or greater than 300, more preferably equal to or greater than 310, and particularly preferably equal to or greater than 320. From the standpoint that each of the dimples 12 can have a sufficient diameter, the total number of the dimples 12 is preferably equal to or less than 500, more preferably equal to or less than 480, and particularly preferably equal to or less than 460.

In light of the dimple effect, a ratio Pn of the number of the dimples 12 with a diameter of equal to or greater than 3.40 mm to the total number of the dimples 12 is preferably equal to or greater than 90%, and particularly preferably equal to or greater than 92%. Ideally, the ratio Pn is 100%. The golf ball 2 shown in FIG. 3 to FIG. 5 has the ratio Pn of 92.1%.

The golf ball 2 according to the present invention has three or more kinds of the dimples 12, each having a different diameter. By setting the number of kinds to be equal to or greater than 3, a great dimple effect is obtained. In this respect, the number of kinds is preferably equal to or greater than 4, and particularly preferably equal to or greater than 5. In light of ease of production, the number of the kinds is preferably equal to or less than 16. The golf ball 2 shown in FIG. 3 to FIG. 5 has 8 kinds of the dimples 12 designated as A to H.

In light of the dimple effect, the number of the kinds of the dimples 12 having a diameter of equal to or greater than 3.40 mm is preferably equal to or greater than 3, more preferably equal to or greater than 4, and particularly preferably equal to or greater than 5. In light of ease of production, the number of the kinds of the dimples 12 having a diameter of equal to or greater than 3.40 mm is preferably equal to or less than 16. The golf ball 2 shown in FIG. 3 to FIG. 5 has 6 kinds of the dimples 12 designated as A to F. The dimples 12 have a diameter of equal to or greater than 3.40 mm.

When two dimples 12 have an equal diameter and a different depth, both of the dimples 12 belong to the same kind. When two dimples 12 have an equal diameter and a different shape of cross-section, both of the two dimples 12 belong to the same kind.

Due to the error caused during the production and measurement, various actual measurement values of the diameter are obtained. In the present invention, when a diameter of the dimple 12 has a difference between an actual measurement value and a design value of less than ±0.05 mm, the diameter of the dimple 12 is considered to have the design value. In the present invention, a diameter of the dimples 12 is measured on the golf ball 2 without being applied any paint. The diameter may be measured on the golf ball 2 after a paint layer is removed.

In light of the dimple effect, a diameter of the dimples 12 of which the diameter is less than 3.40 mm is preferably equal to or greater than 2.0 mm, more preferably equal to or greater than 2.50 mm, and particularly preferably equal to or greater than 3.00 mm. In light of the dimple effect, a diameter of the dimples 12 of which the diameter is equal to or greater than 3.40 mm is preferably equal to or greater than 3.60 mm and more preferably equal to or greater than 3.8 mm. The diameter is preferably equal to or less than 6.00 mm. By setting the diameter to be equal to or less than 6.00 mm, a fundamental feature of the golf ball 2 which is substantially a sphere is maintained. In this respect, the diameter is more preferably equal to or less than 5.80, and particularly preferably equal to or less than 5.60 mm.

The area s of the dimple 12 is an area of a region surrounded by the contour line when the center of the golf ball 2 is viewed at infinity. When the dimples 12 are circular, the area s is calculated by the following formula.

$$s=(Di/2)^2\cdot\pi$$

In the golf ball 2 shown in FIG. 3 to FIG. 5, an area of the dimple A is 16.62 $mm^2$, an area of the dimple B is 15.55 $mm^2$, an area of the dimple C is 14.52 $mm^2$, an area of the dimple D is 13.85 $mm^2$, an area of the dimple E is 13.20 $mm^2$, an area of the dimple F is 11.95 $mm^2$, an area of the dimple G is 8.04 $mm^2$ and an area of the dimple H is 7.07 $mm^2$.

In the present invention, a ratio of summation of the areas s of all the dimples 12 to the surface area of the phantom sphere 28 is referred to as an occupation ratio. From the standpoint that a sufficient dimple effect is achieved, the occupation ratio is preferably equal to or greater than 70%, more preferably equal to or greater than 72%, and particularly preferably equal to or greater than 74%. The occupation ratio is preferably equal to or less than 88% and more preferably equal to or less than 86%. The golf ball 2 shown in FIG. 3 to FIG. 5 has the total area of the dimples 12 of 4700.2 $mm^2$. Because the surface area of the phantom sphere 28 of this golf ball 2 is 5728.0 $mm^2$, the occupation ratio is 82.1%.

In the present invention, "volume of the dimple" means a volume surrounded by a plane including the contour of the dimple 12 and the surface of the dimple 12. In light of reduction of a hopping of the golf ball 2, the total volume of the dimple 12 is preferably equal to or greater than 250 $mm^3$, more preferably equal to or greater than 260 $mm^3$, and particularly preferably equal to or greater than 270 $mm^3$. In light of reduction of a dropping of the golf ball 2, the total volume is preferably equal to or less than 400 $mm^3$, more preferably equal to or less than 390 $mm^3$, and particularly equal to or less than 380 $mm^3$.

In light of reduction of a hopping of the golf ball 2, a depth of the dimple 12 is preferably equal to or greater than 0.05 mm, more preferably equal to or greater than 0.08 mm, and particularly preferably equal to or greater than 0.10 mm. In light of reduction of a dropping of the golf ball 2, the depth is preferably equal to or less than 0.60 mm, more preferably equal to or less than 0.45 mm, and particularly equal to or less than 0.40 mm. The depth is a distance between the tangent line T and the deepest portion of the dimple 12.

Figure 7:
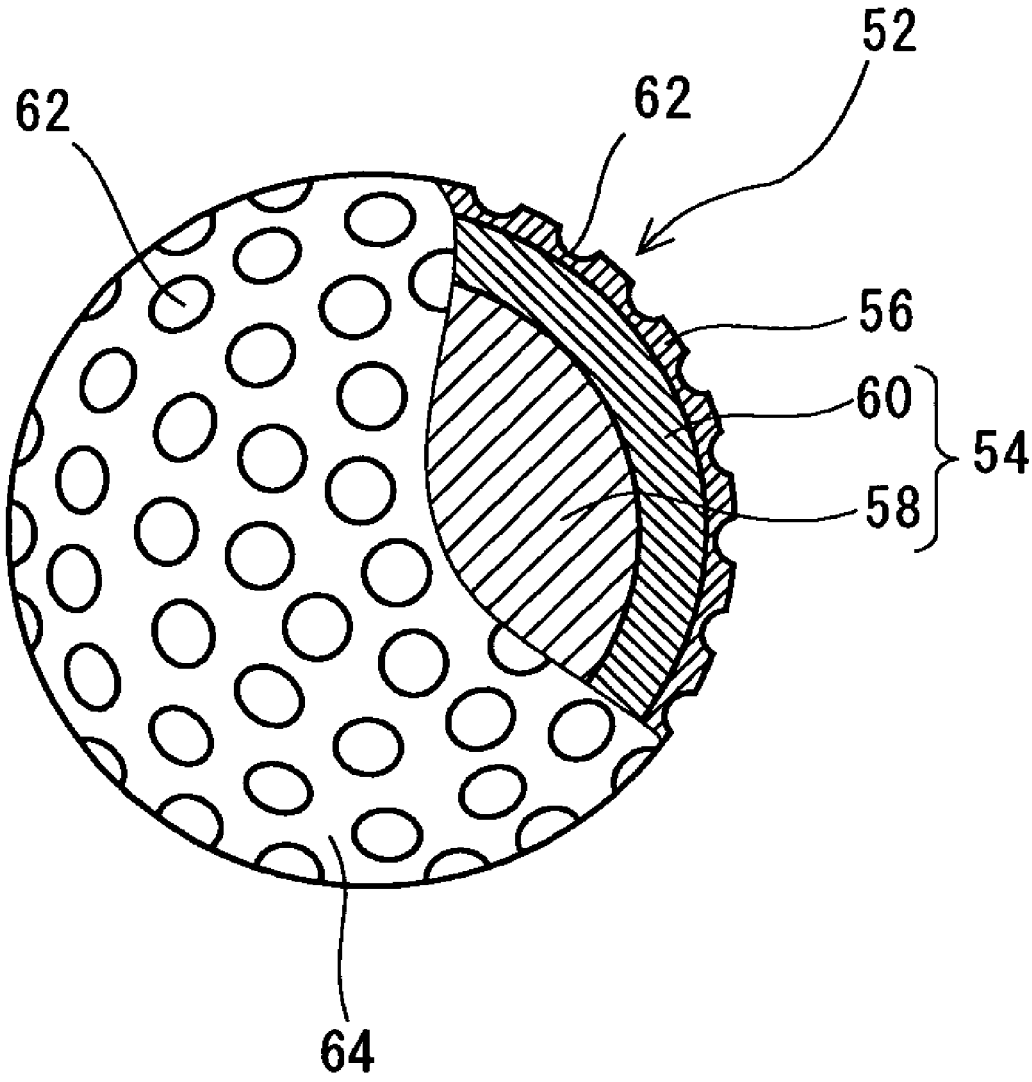
FIG. 7 is a schematic cross-sectional view illustrating a golf ball according to another embodiment of the present invention.

FIG. 7 is a schematic cross-sectional view illustrating a golf ball 52 according to another embodiment of the present invention. This golf ball 52 has a spherical core 54 and a cover 56 covering the core 54. The core 54 comprises a spherical center 58 and a mid layer 60 covering the center 58. Numerous dimples 62 are formed on the surface of the cover 56. A part of the surface of the golf ball 52 except for the dimples 62 is a land 64. This golf ball 52 has a paint layer and a mark layer to the external side of the cover 56, although these layers are not shown in the Figure. Another layer may be formed between the center 58 and the mid layer 60. Another layer may be provided between the mid layer 60 and the cover 56.

The center 58 is formed through crosslinking of a rubber composition. For the center 58, a rubber composition which is equal to the rubber composition in the center 8 shown in FIG. 1, is used. A diameter of the center 58 is preferably 36.0 mm or greater and 42.0 mm or less. The center 58 having a diameter of equal to or greater than 36.0 mm contributes to resilience performance. In this respect, the diameter is more preferably equal to or greater than 37.0 mm. By setting the diameter to be equal to or less than 42.0 mm, the mid layer 60 and the cover 56 contributes to durability. In this respect, the diameter is preferably equal to or less than 41.0 mm.

It is preferred that the center 58 has an amount of compressive deformation C1 of 2.5 mm or greater and 4.0 mm or less. The center 58 having an amount of compressive deformation of equal to or greater than 2.5 mm contributes to soft feel at impact. In this respect, the amount of compressive deformation C1 is more preferably equal to or greater than 2.8 mm, and particularly preferably equal to or greater than 3.0 mm. The center 8 having an amount of compressive deformation C1 of equal to or less than 4.0 mm contributes to resilience performance and durability of the golf ball 52. In this respect, the amount of compressive deformation C1 is more preferably equal to or less than 3.8 mm, and particularly preferably equal to or less than 3.5 mm.

It is preferred that the center 58 has a surface hardness of 45 or greater and 65 or less. The center 58 having a surface hardness of equal to or greater than 45 contributes to resilience performance. In this respect, the surface hardness is more preferably equal to or greater than 47, and particularly equal to or greater than 50. The center 58 having a surface hardness of equal to or less than 65 also contributes to feel at impact. Further, the center 58 having a surface hardness of equal to or less than 65 also contributes to reduction of spin. In this respect, the surface hardness is more preferably equal to or less than 63, and particularly equal to or less than 60. The surface hardness is measured by an automated rubber hardness measurement machine (trade name "P1", available from Koubunshi Keiki Co., Ltd.) which is equipped with a Shore D type spring hardness scale, being pressed to the surface of the center 58.

It is preferred that the center 58 has a weight of 25 g or greater and 42 g or less. Crosslinking temperature of the center 58 is usually 140° C. or greater and 180° C. or less. The crosslinking time period of the center 58 is usually 10 minutes or longer and 60 minutes or less. The center 58 may be formed with two or more layers.

The mid layer 60 comprises a resin composition. Preferable base polymer for the resin composition is a styrene block-containing thermoplastic elastomer and an ionomer resin. For the mid layer 60, a base resin which is equal to the base resin in the mid layer 10 shown in FIG. 1 is used. The resin composition of the mid layer 60 contains a metal oxide with a three-dimensional shape. For the mid layer 60, a metal oxide which is equal to the metal oxide in the mid layer 10 shown in FIG. 1 is used.

It is preferred that a ratio R which is calculated by the following formula (V) is equal to or greater than 1.05.

$$R=((Ym/Xm)/(Yo/Xo)) \quad (V)$$

In the formula (V), Ym represents flexural rigidity (MPa) of the mid layer 60, Xm represents a D hardness of the resin composition, Yo represents flexural rigidity (MPa) of the base resin of the mid layer 60, and Xo represents a D hardness of the base resin. Upon measurement of the hardness Xm and the flexural rigidity Ym, a slab comprising the same resin composition as the resin composition of the mid layer 60. Upon measurement of the hardness Xo and the flexural rigidity Yo, a slab comprising the base resin which is used for the mid layer 60. When two or more base resins are used in combination in the mid layer 60, a slab comprising a blend of these resins is used. The mid layer 60 having the ratio R of equal to or greater than 1.05 contributes to high resilience performance and soft feel at impact. In this respect, the ratio is more preferably equal to or greater than 1.07, and particularly preferably equal to or greater than 1.08. The ratio R is preferably equal to or less than 1.30.

The mid layer 60 has a D hardness Xm of 30 or greater and 45 or less. The mid layer 60 having a D hardness of equal to or greater than 30 does not deteriorate resilience performance. In this respect, the D hardness is more preferably equal to or greater than 32. The mid layer 60 having a D hardness of equal to or less than 45 contributes to soft feel at impact. Further, the mid layer 60 having a D hardness of equal to or less than 45 reduces spin. In this respect, the D hardness is more preferably equal to or less than 40, and particularly preferably equal to or less than 37.

In light of resilience performance, the mid layer 60 has flexural rigidity Ym of equal to or greater than 30 MPa, and particularly preferably equal to or greater than 40 MPa. The flexural rigidity is preferably equal to or less than 100 MPa. The flexural rigidity is measured in accordance with a standard of "JIS K7106". Upon measurement, as mentioned above, a slab comprising the same resin composition as the resin composition of the mid layer 60. This slab is obtained by hot press. Thickness of the slab is 2 mm. The slab which is stored at a temperature of 23° C. for two weeks is used for the measurement.

It is preferred that the mid layer 60 has a thickness of 0.3 mm or greater and 1.2 mm or less. The mid layer 60 having a thickness Tm of equal to or greater than 0.3 mm contributes to soft feel at impact. In this respect, the thickness Tm is more preferably equal to or greater than 0.5 mm. The mid layer 60 having a thickness Tm of equal to or less than 1.2 mm does not deteriorate resilience performance. In this respect, the thickness Tm is more preferably equal to or less than 1.1 mm.

The cover 56 comprises a resin composition. The preferable base resin for the resin composition is an ionomer resin. For the cover 56, a base resin which is equal to the base resin of the cover 6 shown in FIG. 1.

A D hardness of the cover 56 is preferably equal to or greater than 59. This cover 56 contributes to resilience performance. In light of resilience performance, the D hardness is preferably equal to or greater than 60, and particularly preferably equal to or greater than 61. In light of feel at impact, the D hardness is preferably equal to or less than 70 and more preferably equal to or less than 67. Upon measurement of the D hardness, a slab comprising the same resin composition as the resin composition of the cover 56 is used. Details of the measurement are as mentioned above.

It is preferred that the cover 56 has a thickness of 0.8 mm or greater and 1.4 mm or less. The cover 56 having a thickness of equal to or greater than 0.8 mm contributes to flight performance and durability. In this respect, the thickness is more preferably equal to or greater than 1.0 mm. The cover 56 having a thickness of equal to or less than 1.4 mm does not deteriorate feel at impact and resilience performance. In this respect, the thickness is more preferably equal to or less than 1.3 mm.

An amount of compressive deformation C3 of the golf ball 52 is preferably 2.0 mm or greater and 3.2 mm or less. The golf ball 52 having an amount of compressive deformation C3 of equal to or greater than 2.0 mm is excellent in feel at impact. In this respect, the amount of compressive deformation C3 is more preferably equal to or greater than 2.2 mm, and particularly preferably equal to or greater than 2.4 mm. The golf ball 52 having an amount of compressive deformation C3 of equal to or less than 3.2 mm is excellent in durability. In this respect, the amount of compressive deformation C3 is more preferably equal to or less than 3.0 mm, and particularly preferably equal to or less than 2.9 mm.

A difference between the amount of compressive deformation C1 of the center 58 and the amount of compressive deformation C3 of the golf ball 52, (C1-C3), is preferably 0.20 mm or greater and 0.75 mm or less. By setting the difference (C1-C3) to be equal to or greater than 0.20 mm, the cover 56 contributes to resilience performance and durability. In this respect, the difference (C1-C3) is preferably equal to or greater than 0.30 mm. By setting the difference (C1-C3) to be equal to or less than 0.75 mm, the mid layer 60 and the cover 56 do not deteriorate feel at impact. In this respect, the difference (C1-C3) is more preferably equal to or less than 0.70 mm, and particularly preferably equal to or less than 0.65 mm.

This golf ball 52 has dimple patterns shown in FIG. 3 to FIG. 6. The golf ball 52 has dimples A having a diameter of 4.60 mm, dimples B having a diameter of 4.45 mm, dimples C having a diameter of 4.30 mm, dimples D having a diameter of 4.20 mm, dimples E having a diameter of 4.10 mm, dimples F having a diameter of 3.90 mm, dimples G having a diameter of 3.20 mm, and dimples H having a diameter of 3.00 mm. The number of the dimples A is 70; the number of the dimples B is 88; the number of the dimples C is 56; the number of the dimples D is 26; the number of the dimples E is 42; the number of the dimples F is 20; the number of the dimples G is 18; and the number of the dimples H is 8. Total number of the dimples 62 is 328. The dimple patterns of the golf ball 52 meet the aforementioned formulae (I), (II), (III) and (IV).

EXAMPLES

Experiment 1

Example 1

A rubber composition (a) was obtained by kneading 100 parts by weight of high cis-polybutadiene (trade name "BR-730", available from JSR Corporation), 24.0 parts by weight of zinc diacrylate, 10 parts of zinc oxide, an adequate amount of barium sulfate, 0.5 part by weight of diphenyl disulfide (manufactured by Sumitomo Seika Chemicals Co., Ltd.) and 0.8 part by weight of dicumyl peroxide (manufactured by NOF Corporation). This rubber composition (a) was placed into a mold having upper and lower mold half each having a hemispherical cavity, and heated at 170° C. for 20 minutes to obtain a center having a diameter of 38.0 mm. On the other hand, in a biaxial kneading extruder, a resin composition (f) was obtained by kneading 28 parts by weight of ionomer resin (trade name "Surlyn® 8945", available from Dupont), 27 parts by weight of another ionomer resin (trade name "Surlyn® 9945" available from Dupont), 45 parts by weight of styrene block-containing thermoplastic elastomer (trade name "Rabalon® T3221C" available from Mitsubishi Chemical Corporation), 1.0 part by weight of zinc oxide with a three-dimensional shape (trade name "Panatetra WZ-0501", available from Matsushita Electronic Industrial Co., Ltd.), 3.0 parts by weight of titanium dioxide and 0.04 part by weight of ultramarine. This zinc oxide has a shape shown in FIG. 2. A mean length of needle-like parts of the zinc oxide is 10 μm. A core comprising a center and a mid layer was obtained by covering around the center with this resin composition (f) by injection molding. A thickness of the mid layer was 1.4 mm. Further, in a biaxial kneading extruder, a resin composition (j) was obtained by kneading 52 parts by weight of ionomer resin (the aforementioned trade name "Surlyn® 8945"), 40 parts by weight of another ionomer resin (the aforementioned trade name "Surlyn® 9945"), 8 parts by weight of a styrene block-containing thermoplastic elastomer (the aforementioned trade name "Rabalon® T3221C"), 2 parts by weight of titanium dioxide and 0.04 part by weight of ultramarine. The aforementioned core was placed into a final mold having numerous pimples on the inside face, followed by injection of the aforementioned resin composition (j) around the core by injection molding to form a cover. A thickness of the cover was 1.4 mm. Numerous dimples having a shape inverted from the shape of the pimple were formed on the cover. A clear paint including a two-part liquid curable polyurethane as a base was applied on this cover to give a golf ball of Example 1 having a diameter of 42.8 mm and a weight of about 45.4 g. This golf ball has a dimple pattern shown in FIG. 3 to FIG. 5. Details of specifications of the dimples are shown in Table 4 below. Distribution of the dimples is shown in Table 6 below.

Examples 2 to 3

In a similar manner to Example 1 except that specification of the center is as shown in Table 8 below, golf balls of Example 2 to 3 were obtained. Details of the specification of the center are shown in Table 1 below.

Comparative Example 1

In a similar manner to Example 1 except that specification of the mid layer is as shown in Table 8 below, a golf ball of Comparative Example 1 was obtained. Details of the specification of the mid layer are shown in Table 2 below.

Comparative Examples 2 to 7

In a similar manner to Example 1 except that specifications of the dimples are as shown in Tables 8 to 10 below, dimples of Comparative Examples 2 to 7 were obtained. Details of the specifications of the dimples are shown in Tables 4 and 5 below. Distribution of the dimples is shown in Tables 6 and 7 below.

Comparative Example 8

In a similar manner to Example 1 except that specifications of the center and the cover are as shown in Table 10 below, a golf ball of Comparative Example 8 was obtained. Details of the specification of the center are shown in Table 1 below. Details of the specification of the cover are shown in Table 3 below.

Comparative Examples 9 to 10

In a similar manner to Example 1 except that specifications of the center and the mid layer are as shown in Table 10 below, golf balls of Comparative Examples 9 to 10 were obtained. Details of the specification of the center are shown in Table 1 below. Details of the specification of the mid layer are shown in Table 2 below.

TABLE 1

Rubber composition of center (parts by weight)

| | Type | | | | |
|---|---|---|---|---|---|
| | a | b | c | d | e |
| BR-730 | 100 | 100 | 100 | 100 | 100 |
| Zinc acrylate | 24.0 | 23.0 | 25.5 | 21.5 | 27.5 |
| Zinc oxide | 10 | 10 | 10 | 10 | 10 |
| Barium sulfate | appropriate amount | appropriate amount | appropriate amount | appropriate amount | appropriate amount |
| Diphenyl disulfide | 0.5 | 0.5 | 0.5 | 0.5 | 0.5 |
| Dicumyl peroxide | 0.8 | 0.8 | 0.8 | 0.8 | 0.8 |

TABLE 2

Resin composition of mid layer (parts by weight)

| Type | f | g | h | i |
|---|---|---|---|---|
| Surlyn 8945 | 28 | 28 | 32 | 23 |
| Surlyn 9945 | 27 | 27 | 32 | 23 |
| Rabalon T3221C | 45 | 45 | 36 | 54 |
| Panatetra WZ-0501 | 1.0 | — | 1.0 | 1.0 |
| Titanium dioxide | 3.0 | 3.0 | 3.0 | 3.0 |
| Ultramarine | 0.04 | 0.04 | 0.04 | 0.04 |
| D Hardness (Shore D) | 37 | 37 | 42 | 30 |

TABLE 3

Resin composition of cover (parts by weight)

| Type | j | k |
|---|---|---|
| Surlyn 8945 | 52 | 46 |
| Surlyn 9945 | 40 | 40 |

TABLE 3-continued

| Resin composition of cover | | |
|---|---|---|
| | | (parts by weight) |
| Type | j | k |
| Rabalon T3221C | 8 | 14 |
| Titanium dioxide | 2 | 2 |
| Ultramarine | 0.04 | 0.04 |
| D Hardness (Shore D) | 59 | 56 |

TABLE 4

Figure 8:
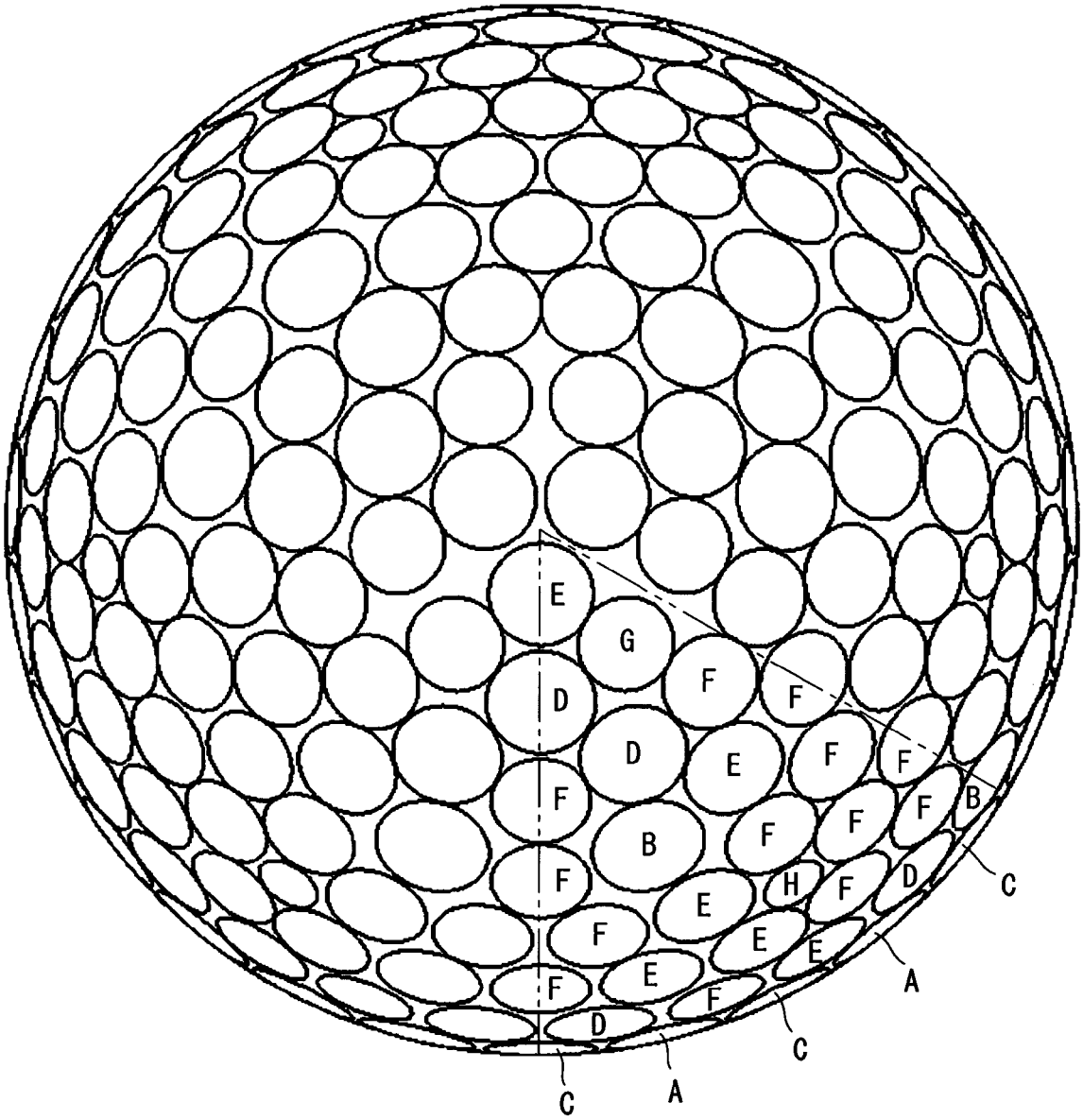
FIG. 8 is a plane view illustrating a golf ball of a Comparative Example 2.
Figure 9:
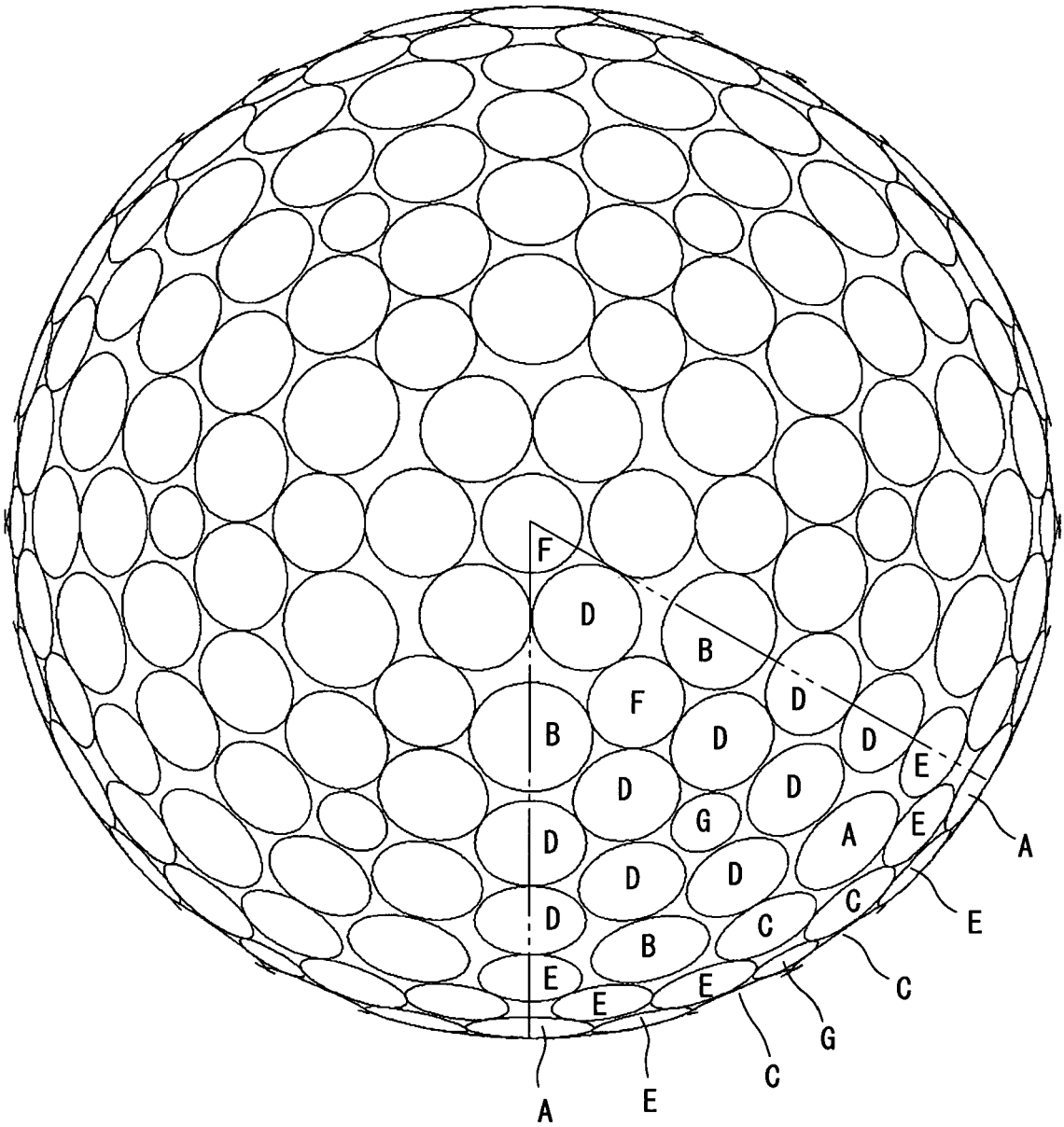
FIG. 9 is a plane view illustrating a golf ball of a Comparative Example 3.

| Specifications of dimples | | | | | | | | |
|---|---|---|---|---|---|---|---|---|
| Type | Kind | Number | Diameter (mm) | Depth (mm) | Curvature rudius (mm) | Volume ($mm^3$) | Total volume ($mm^3$) | Plane view |
| (i) | A | 70 | 4.60 | 0.1380 | 19.24 | 1.148 | 324.8 | FIG. 3 |
| | B | 88 | 4.45 | 0.1380 | 18.01 | 1.075 | | |
| | C | 56 | 4.30 | 0.1380 | 16.82 | 1.003 | | |
| | D | 26 | 4.20 | 0.1380 | 16.05 | 0.957 | | |
| | E | 42 | 4.10 | 0.1380 | 15.30 | 0.912 | | |
| | F | 20 | 3.90 | 0.1380 | 13.85 | 0.826 | | |
| | G | 18 | 3.20 | 0.1380 | 9.34 | 0.556 | | |
| | H | 8 | 3.00 | 0.1380 | 8.22 | 0.489 | | |
| (ii) | A | 24 | 4.70 | 0.1430 | 19.38 | 1.242 | 324.7 | FIG. 8 |
| | B | 18 | 4.60 | 0.1430 | 18.57 | 1.190 | | |
| | C | 30 | 4.50 | 0.1430 | 17.17 | 1.139 | | |
| | D | 42 | 4.40 | 0.1430 | 16.99 | 1.089 | | |
| | E | 66 | 4.20 | 0.1430 | 15.49 | 0.992 | | |
| | F | 126 | 4.00 | 0.1430 | 14.06 | 0.900 | | |
| | G | 12 | 3.90 | 0.1430 | 13.37 | 0.856 | | |
| | H | 12 | 2.60 | 0.1380 | 6.19 | 0.368 | | |
| (iii) | A | 24 | 5.15 | 0.1400 | 23.75 | 1.460 | 325.2 | FIG. 9 |
| | B | 24 | 5.00 | 0.1390 | 22.55 | 1.366 | | |
| | C | 60 | 4.60 | 0.1390 | 19.10 | 1.156 | | |
| | D | 96 | 4.50 | 0.1390 | 18.28 | 1.107 | | |
| | E | 60 | 4.20 | 0.1390 | 15.93 | 0.964 | | |
| | F | 14 | 4.10 | 0.1390 | 15.19 | 0.919 | | |
| | G | 24 | 2.90 | 0.1390 | 7.63 | 0.460 | | |

TABLE 5

Figure 10:
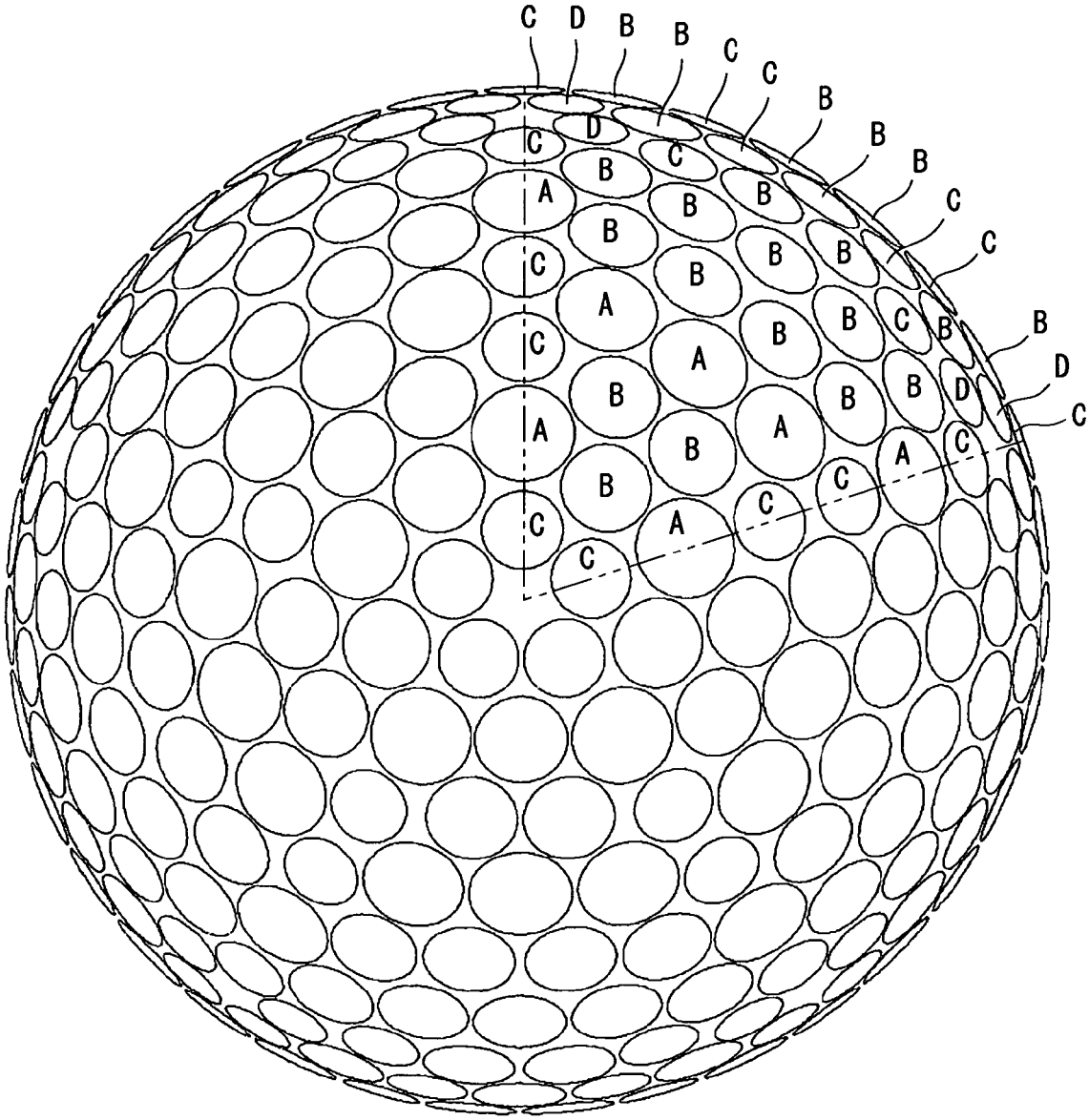
FIG. 10 is a plane view illustrating a golf ball of a Comparative Example 4.
Figure 11:
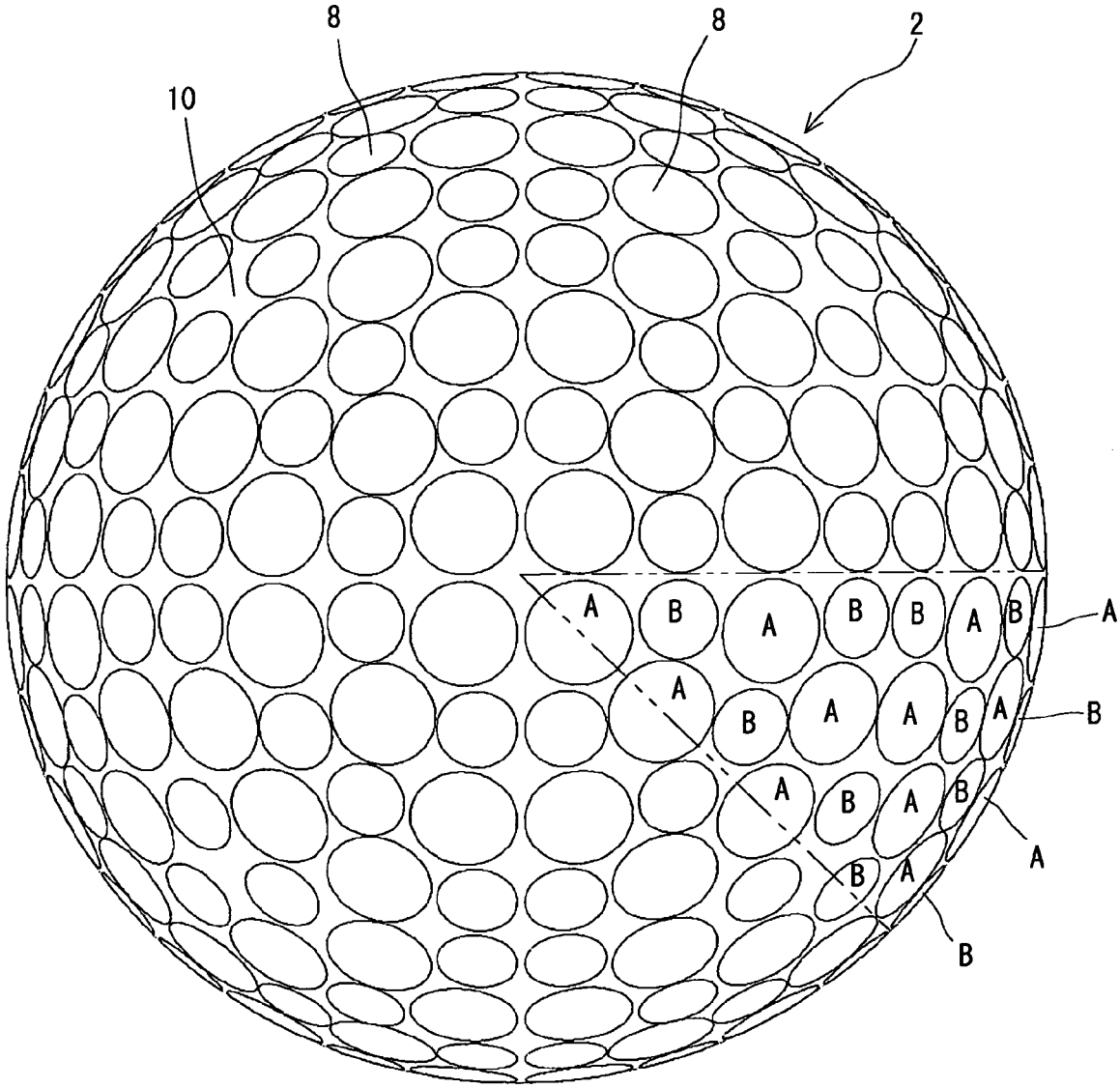
FIG. 11 is a plane view illustrating a golf ball of a Comparative Example 5.
Figure 12:
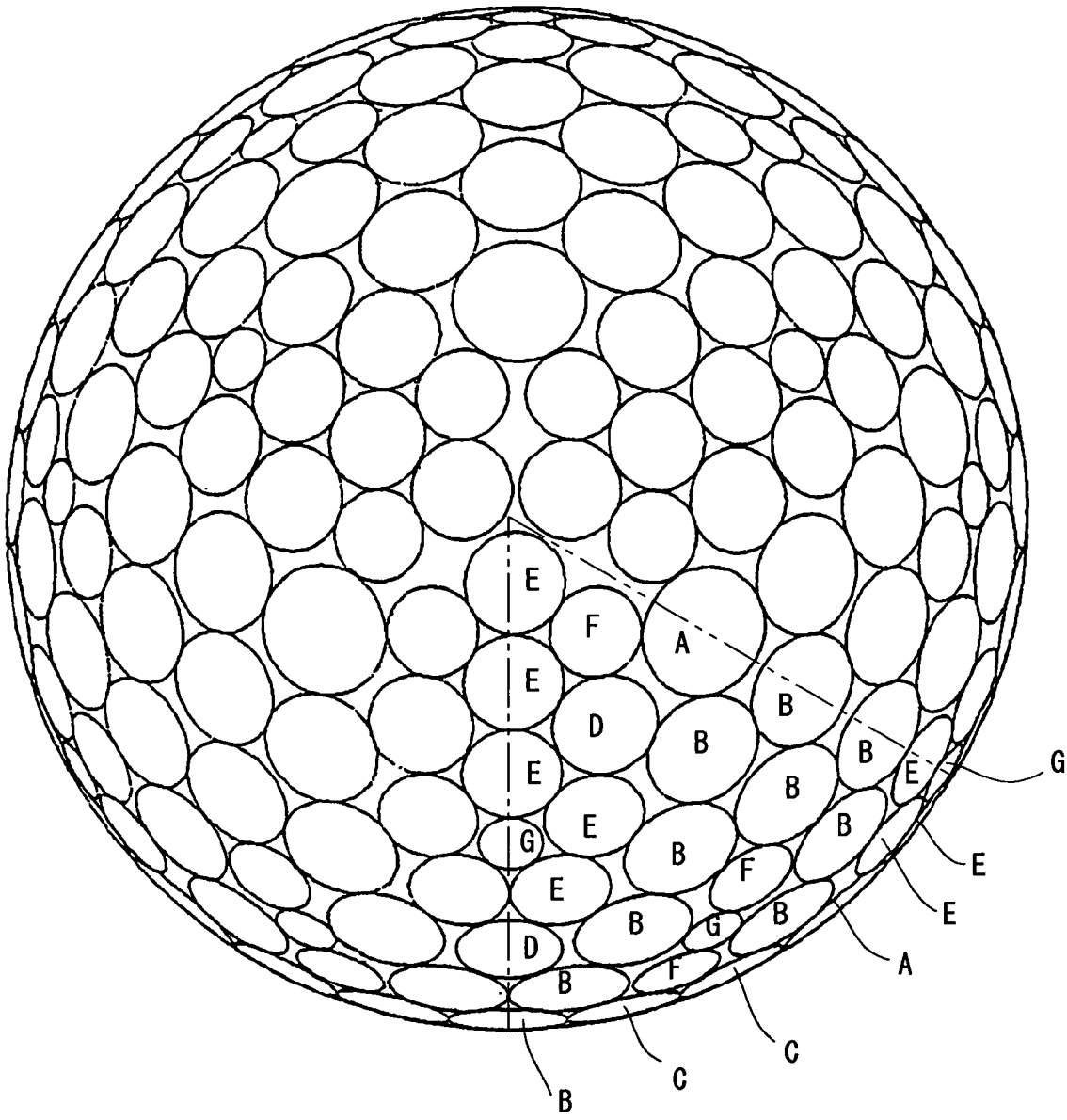
FIG. 12 is a plane view illustrating a golf ball of a Comparative Example 6.
Figure 13:
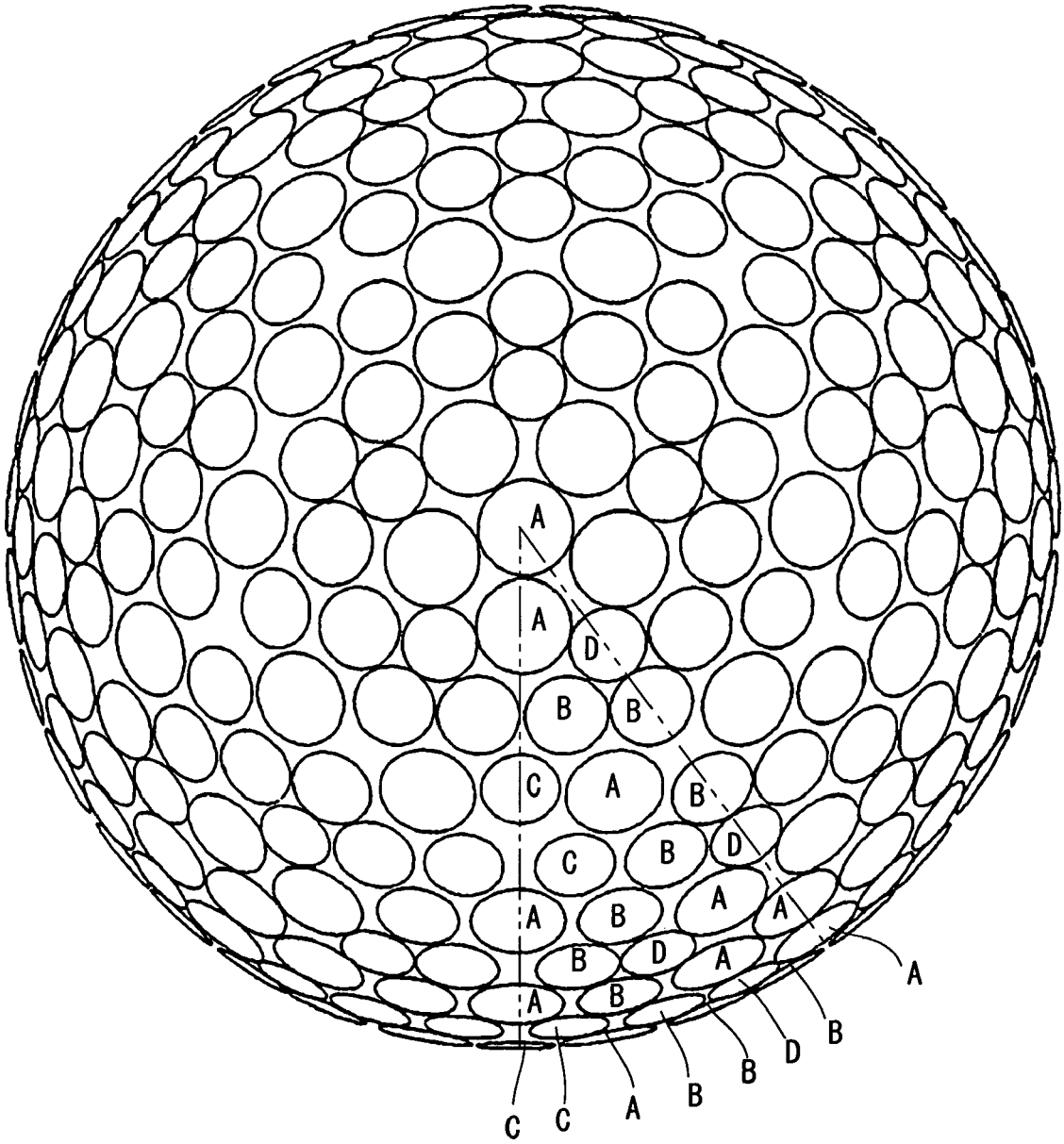
FIG. 13 is a plane view illustrating a golf ball of a Comparative Example 7.

| Specifications of dimples | | | | | | | | |
|---|---|---|---|---|---|---|---|---|
| Type | Kind | Number | Diameter (mm) | Depth (mm) | Curvature rudius (mm) | Volume ($mm^3$) | Total volume ($mm^3$) | Plane view |
| (iv) | A | 50 | 4.20 | 0.1530 | 14.49 | 1.062 | 324.5 | FIG. 10 |
| | B | 210 | 3.75 | 0.1520 | 11.64 | 0.841 | | |
| | C | 110 | 3.30 | 0.1520 | 9.03 | 0.652 | | |
| | D | 40 | 3.10 | 0.1520 | 7.98 | 0.575 | | |
| (v) | A | 168 | 4.60 | 0.1480 | 17.95 | 1.232 | 325.2 | FIG. 11 |
| | B | 168 | 3.50 | 0.1460 | 10.56 | 0.704 | | |
| (vi) | A | 18 | 5.60 | 0.1350 | 29.10 | 1.664 | 325.3 | FIG. 12 |
| | B | 102 | 5.10 | 0.1340 | 24.33 | 1.370 | | |
| | C | 24 | 4.85 | 0.1340 | 22.01 | 1.239 | | |
| | D | 18 | 4.50 | 0.1340 | 18.96 | 1.067 | | |
| | E | 72 | 4.25 | 0.1340 | 16.92 | 0.952 | | |
| | F | 36 | 3.90 | 0.1340 | 14.26 | 0.802 | | |
| | G | 24 | 2.75 | 0.1300 | 7.34 | 0.387 | | |
| (vii) | A | 132 | 4.10 | 0.1420 | 14.87 | 0.939 | 324.9 | FIG. 13 |
| | B | 180 | 3.55 | 0.1420 | 11.16 | 0.704 | | |
| | C | 60 | 3.40 | 0.1420 | 10.25 | 0.646 | | |
| | D | 60 | 3.25 | 0.1420 | 9.37 | 0.590 | | |

TABLE 6

| Type | Kind | Distribution of dimples | | | | | | | | |
|---|---|---|---|---|---|---|---|---|---|---|
| | | First region | Second region | Third region | Fourth region | Fifth region | Sixth region | Seventh region | Eighth region | Ninth region |
| (i) | A | — | — | — | — | 30 | 20 | 20 | — | — |
| | B | 24 | 12 | 12 | 40 | — | — | — | — | — |
| | C | 18 | 24 | 14 | — | — | — | — | — | — |
| | D | 6 | 16 | 4 | — | — | — | — | — | — |
| | E | — | — | 12 | 10 | — | — | — | 20 | — |
| | F | 12 | 8 | — | — | — | — | — | — | — |
| | G | — | — | 8 | — | — | — | — | — | 10 |
| | H | — | — | 6 | — | — | — | — | — | 2 |
| (ii) | A | 24 | — | — | — | — | — | — | — | — |
| | B | — | 6 | — | — | — | 12 | — | — | — |
| | C | 30 | — | — | — | — | — | — | — | — |
| | D | — | 24 | — | — | — | — | 12 | 6 | — |
| | E | — | 12 | 24 | 12 | — | 12 | — | — | 6 |
| | F | — | 12 | 30 | 30 | 30 | 12 | 12 | — | — |
| | G | — | — | — | — | — | — | — | 12 | — |
| | H | — | — | — | 12 | — | — | — | — | — |
| (iii) | A | 12 | — | — | 12 | — | — | — | — | — |
| | B | — | — | — | 12 | — | — | 12 | — | — |
| | C | 24 | 24 | 12 | — | — | — | — | — | — |
| | D | — | — | — | 24 | 24 | 36 | — | 12 | — |
| | E | 24 | 24 | 12 | — | — | — | — | — | — |
| | F | — | — | — | — | — | — | 12 | — | 2 |
| | G | — | 12 | — | — | 12 | — | — | — | — |

TABLE 7

| Type | Kind | Distribution of dimples | | | | | | | | |
|---|---|---|---|---|---|---|---|---|---|---|
| | | First region | Second region | Third region | Fourth region | Fifth region | Sixth region | Seventh region | Eighth region | Ninth region |
| (iv) | A | — | — | — | 10 | — | 30 | — | 10 | — |
| | B | 40 | 30 | 20 | 50 | 40 | — | 20 | 10 | — |
| | C | 30 | 20 | 30 | — | 10 | — | 10 | — | 10 |
| | D | — | 20 | 20 | — | — | — | — | — | — |
| (v) | A | 32 | 32 | 32 | 16 | 24 | — | 24 | — | 8 |
| | B | 32 | 32 | 24 | 32 | 16 | 16 | — | 16 | — |
| (vi) | A | 12 | — | — | — | — | — | 6 | — | — |
| | B | 6 | 12 | 24 | 30 | 18 | 12 | — | — | — |
| | C | 24 | — | — | — | — | — | — | — | — |
| | D | — | — | — | 6 | — | — | 12 | — | — |
| | E | 12 | 12 | 6 | — | 12 | 12 | 6 | 6 | 6 |
| | F | — | 12 | — | 12 | — | — | — | 12 | — |
| | G | — | 6 | 12 | — | — | 6 | — | — | — |
| (vii) | A | 20 | 10 | 40 | 20 | 10 | 20 | — | 10 | 2 |
| | B | 40 | 20 | 20 | 40 | 20 | 10 | 30 | — | — |
| | C | 10 | 20 | — | — | 20 | 10 | — | — | — |
| | D | — | 20 | 20 | — | 10 | — | — | 10 | — |

[Evaluation of Feel at Impact]

Using a driver, the golf balls were hit by a golf player, and feel at impact was rated according to the following ranks.

A: extremely favorable

B: favorable

C: unfavorable

The results are presented in Tables 8 to 10 below.

[Flight Distance Test]

A driver with a titanium head (trade name "XXIO", available from SRI Sports Limited, shaft hardness: S, loft angle: 10°) was attached to a swing machine, available from True Temper Co. Then the golf ball was hit under the condition to provide a head speed of 45 m/sec, and the distance from the launching point to the point where the ball stopped was measured. Mean values of the data obtained by 10 times measurement are shown in Tables 8 to 10 below.

TABLE 8

| | | | Results of evaluation | | | | |
|---|---|---|---|---|---|---|---|
| | | | Example 1 | Comp. Example 1 | Example 2 | Example 3 | Comp. Example 2 |
| Center | Type | | a | a | d | e | a |
| Mid layer | Type | | f | g | f | f | f |
| | D Hardness | | 37 | 37 | 37 | 37 | 37 |
| | Panatetra WZ-0501 | | 1.0 | — | 1.0 | 1.0 | 1.0 |
| Cover | Type | | j | j | j | j | j |
| | D Hardness | | 59 | 59 | 59 | 59 | 59 |
| Amount of compressive deformation | Center C1 (mm) | | 4.4 | 4.4 | 4.9 | 3.7 | 4.4 |
| | Core C2 (mm) | | 4.2 | 4.2 | 4.6 | 3.5 | 4.2 |
| | Ball C3 (mm) | | 3.6 | 3.6 | 4.0 | 3.0 | 3.6 |
| | C1/C2 | | 1.05 | 1.05 | 1.07 | 1.06 | 1.05 |
| | C1/C3 | | 1.22 | 1.22 | 1.23 | 1.23 | 1.22 |
| Dimple | Type | | (i) | (i) | (i) | (i) | (ii) |
| | Number of kinds | N1 | 4 | 4 | 4 | 4 | 2 |
| | | N2 | 4 | 4 | 4 | 4 | 4 |
| | | N3 | 4 | 4 | 4 | 4 | 2 |
| | | N4 | 2 | 2 | 2 | 2 | 2 |
| | | N5 | 1 | 1 | 1 | 1 | 1 |
| | | N6 | 1 | 1 | 1 | 1 | 3 |
| | | N7 | 1 | 1 | 1 | 1 | 2 |
| | | N8 | 1 | 1 | 1 | 1 | 2 |
| | | N9 | 0 | 0 | 0 | 0 | 1 |
| | | NL | 5 | 5 | 5 | 5 | 6 |
| | | NH | 3 | 3 | 3 | 3 | 5 |
| | | NHm | 3 | 3 | 3 | 3 | 3 |
| | | NHp | 2 | 2 | 2 | 2 | 4 |
| | Total number | | 328 | 328 | 328 | 328 | 330 |
| | Ratio Pn (%) | | 92.1 | 92.1 | 92.1 | 92.1 | 96.4 |
| Feel at impact | | | A | A | A | B | A |
| Flight distance (m) | | | 247 | 244 | 245 | 248 | 242 |

TABLE 9

| | | | Results of evaluation | | | |
|---|---|---|---|---|---|---|
| | | | Comp. Example 3 | Comp. Example 4 | Comp. Example 5 | Comp. Example 6 |
| Center | Type | | a | a | a | a |
| Mid layer | Type | | f | f | f | f |
| | D Hardness | | 37 | 37 | 37 | 37 |
| | Panatetra WZ-0501 | | 1.0 | 1.0 | 1.0 | 1.0 |
| Cover | Type | | j | j | j | j |
| | D Hardness | | 59 | 59 | 59 | 59 |
| Amount of compressive deformation | Center C1 (mm) | | 4.4 | 4.4 | 4.4 | 4.4 |
| | Core C2 (mm) | | 4.2 | 4.2 | 4.2 | 4.2 |
| | Ball C3 (mm) | | 3.6 | 3.6 | 3.6 | 3.6 |
| | C1/C2 | | 1.05 | 1.05 | 1.05 | 1.05 |
| | C1/C3 | | 1.22 | 1.22 | 1.22 | 1.22 |
| Dimple | Type | | (iii) | (iv) | (v) | (vi) |
| | Number of kinds | N1 | 3 | 2 | 2 | 4 |
| | | N2 | 2 | 2 | 2 | 3 |
| | | N3 | 2 | 2 | 2 | 2 |
| | | N4 | 3 | 2 | 2 | 3 |
| | | N5 | 1 | 2 | 2 | 2 |
| | | N6 | 1 | 1 | 1 | 2 |
| | | N7 | 2 | 2 | 1 | 3 |
| | | N8 | 1 | 2 | 1 | 2 |
| | | N9 | 1 | 1 | 1 | 1 |
| | | NL | 3 | 2 | 2 | 5 |
| | | NH | 4 | 3 | 2 | 5 |
| | | NHm | 3 | 3 | 2 | 4 |
| | | NHp | 3 | 3 | 2 | 4 |
| | Total number | | 302 | 410 | 336 | 294 |
| | Ratio Pn (%) | | 92.1 | 90.2 | 100 | 91.8 |
| Feel at impact | | | A | A | A | A |
| Flight distance (m) | | | 243 | 242 | 242 | 242 |

TABLE 10

Results of evaluation

| | | | Comp. Example 7 | Comp. Example 8 | Comp. Example 9 | Comp. Example 10 |
|---|---|---|---|---|---|---|
| Center | Type | | a | c | b | c |
| Mid layer | Type | | f | f | h | i |
| | D Hardness | | 37 | 37 | 42 | 30 |
| | Panatetra WZ-0501 | | 1.0 | 1.0 | 1.0 | 1.0 |
| Cover | Type | | j | k | j | j |
| | D Harndess | | 59 | 56 | 59 | 59 |
| Amount of compressive deformation | Center C1 (mm) | | 4.4 | 4.1 | 4.6 | 4.1 |
| | Core C2 (mm) | | 4.2 | 3.9 | 4.2 | 4.0 |
| | Ball C3 (mm) | | 3.6 | 3.6 | 3.6 | 3.7 |
| | C1/C2 | | 1.05 | 1.05 | 1.10 | 1.03 |
| | C1/C3 | | 1.22 | 1.14 | 1.28 | 1.11 |
| Dimple | Type | | (vii) | (i) | (i) | (i) |
| | Number of kinds | N1 | 3 | 4 | 4 | 4 |
| | | N2 | 3 | 4 | 4 | 4 |
| | | N3 | 2 | 4 | 4 | 4 |
| | | N4 | 2 | 2 | 2 | 2 |
| | | N5 | 3 | 1 | 1 | 1 |
| | | N6 | 3 | 1 | 1 | 1 |
| | | N7 | 1 | 1 | 1 | 1 |
| | | N8 | 1 | 1 | 1 | 1 |
| | | N9 | 1 | 0 | 0 | 0 |
| | | NL | 3 | 5 | 5 | 5 |
| | | NH | 3 | 3 | 3 | 3 |
| | | NHm | 3 | 3 | 3 | 3 |
| | | NHp | 2 | 2 | 2 | 2 |
| | Total number | | 432 | 328 | 328 | 328 |
| | Ratio Pn (%) | | 86.1 | 92.1 | 92.1 | 92.1 |
| Feel at impact | | | A | A | C | A |
| Flight distance (m) | | | 243 | 242 | 243 | 242 |

As shown in Tables 8 to 10, the golf balls in Examples are excellent in both of the feel at impact and flight performance. Accordingly, advantages of the present invention are clearly indicated by this result of evaluation.

Experiment 2

Example 4

A rubber composition (1) was obtained by kneading 100 parts by weight of high cis-polybutadiene (trade name "BR-730", available from JSR Corporation), 27.5 parts by weight of zinc diacrylate, 10 parts of zinc oxide, an adequate amount of barium sulfate, 0.3 part by weight of bis(pentabromophenyl)disulfide and 0.7 part by weight of dicumyl peroxide (manufactured by NOF Corporation). This rubber composition (1) was placed into a mold having upper and lower mold half each having a hemispherical cavity, and heated at 170° C. for 30 minutes to obtain a center having a diameter of 38.7 mm. On the other hand, a resin composition (p) was obtained by kneading 30 parts by weight of ionomer resin (trade name "Himilan 1605", available from Du Pont-MITSUI POLYCHEMICALS Co., Ltd.), 25 parts by weight of another ionomer resin (trade name "Himilan 1706", available from Du Pont-MITSUI POLYCHEMICALS Co., Ltd.), 45 parts by weight of styrene block-containing thermoplastic elastomer (trade name "Rabalon® T3221C" available from Mitsubishi Chemical Corporation) and 5.0 part by weight of zinc oxide with a three-dimensional shape (trade name "Panatetra WZ-0501", available from Matsushita Electronic Industrial Co., Ltd.). This zinc oxide has a shape shown in FIG. 2. A mean length of needle-like parts of the zinc oxide is 10 μm. A core comprising a center and a mid layer was obtained by covering around the center with this resin composition (p) by injection molding. Further, a resin composition (v) was obtained by kneading 50 parts by weight of ionomer resin (trade name "Surlyn® 8945", available from Dupont), 47 parts by weight of another ionomer resin (trade name "Himilan 7329", available from Du Pont-MITSUI POLYCHEMICALS Co., Ltd.), 3 parts by weight of a styrene block-containing thermoplastic elastomer (the aforementioned trade name "Rabalon® T3221C"), 2 parts by weight of titanium dioxide and 2 parts by weight of barium sulfate. The aforementioned core was placed into a final mold having numerous pimples on the inside face, followed by injection of the aforementioned resin composition (v) around the core by injection molding to form a cover. Numerous dimples having a shape inverted from the shape of the pimple were formed on the cover. A clear paint including a two-part liquid curable polyurethane as a base was applied on this cover to give a golf ball of Example 4 having a diameter of 42.7 mm and a weight of about 45.4 g. This golf ball has a dimple pattern shown in FIG. 3 to FIG. 5. Details of specifications of the dimples are shown in Table 14 below. Distribution of the dimples is shown in Table 15 below.

Examples 5 to 7

In a similar manner to Example 4 except that specifications of the center, the mid layer and the cover are as shown in Table 16 below, golf balls of Examples 5 to 7 were obtained. Details of the specification of the center are shown in Table 11 below, details of the specification of the mid layer are shown in Table 12 below and details of the specification of the cover are shown in Table 13 below.

Comparative Examples 11 to 14

In a similar manner to Example 4 except that specifications of the center, the mid layer, the cover and the dimples are as shown in Table 17 below, golf balls of Comparative Examples 11 to 14 were obtained.

TABLE 11

Rubber compsition of center (parts by weight)

| Type | l | m | n |
|---|---|---|---|
| BR-730 | 100 | 100 | 100 |
| Zinc acrylate | 27.5 | 29.5 | 25.5 |
| Zinc oxide | 10 | 10 | 10 |
| Barium sulfate | appropriate amount | appropriate amount | appropriate amount |
| Bis(pentabromo-phenyl)disulfide | 0.3 | 0.3 | 0.3 |
| Dicumyl peroxide | 0.7 | 0.7 | 0.7 |
| Amount of compressive deformation C1 (mm) | 3.4 | 3.0 | 3.8 |

TABLE 12

Resin composition of mid layer (parts by weight)

| | Type | | | | | | |
|---|---|---|---|---|---|---|---|
| | o | p | q | r | s | t | u |
| Himilan 1605 | 30 | 30 | 30 | 40 | 30 | 30 | 35 |
| Himilan 1706 | 25 | 25 | 25 | 35 | 25 | 25 | 30 |
| Rabalon T3221C | 45 | 45 | 45 | 25 | 45 | 45 | 35 |
| Panatetra WZ-0501 | — | 5.0 | 0.3 | — | — | — | 5.0 |
| WHITESEAL *1 | — | — | — | — | 5.0 | — | — |
| Alborex YS3A *2 | — | — | — | — | — | 5.0 | — |
| D Hardness Xm (Shore D) | 35 | 35 | 35 | 50 | 35 | 37 | 43 |
| flexural rigidity Ym (MPa) | 48 | 52 | 50.5 | 105 | 48 | 52.5 | 82 |

*1 Zinc oxide from PT. INDO LYSAGHT (particle size: 344 μm)
*2 Aluminum borate whiskers from SHIKOKU CHEMICALS CORPORATION

TABLE 13

Resin composition of cover (parts by weight)

| Type | V | W | X |
|---|---|---|---|
| Surlyn 8945 | 50 | — | 50 |
| Himilan 7329 | 47 | — | 50 |
| Rabalon T3221C | 3 | — | — |
| Himilan 1555 | — | 50 | — |
| Himilan 1557 | — | 50 | — |
| Titanium dioxide | 2 | 2 | 2 |
| Barium sulfate | 2 | 2 | 2 |
| D Hardness (Shore D) | 61 | 58 | 64 |

TABLE 14

Specifications of dimples

| Type | Kind | Number | Diameter (mm) | Depth (mm) | Curvature radius (mm) | Volume ($mm^3$) | Total volume ($mm^3$) | Plane view |
|---|---|---|---|---|---|---|---|---|
| (i) | A | 70 | 4.60 | 0.1380 | 19.24 | 1.148 | 324.8 | FIG. 3 |
| | B | 88 | 4.45 | 0.1380 | 18.01 | 1.075 | | |
| | C | 56 | 4.30 | 0.1380 | 16.82 | 1.003 | | |
| | D | 26 | 4.20 | 0.1380 | 16.05 | 0.957 | | |
| | E | 42 | 4.10 | 0.1380 | 15.30 | 0.912 | | |
| | F | 20 | 3.90 | 0.1380 | 13.85 | 0.826 | | |
| | G | 18 | 3.20 | 0.1380 | 9.34 | 0.556 | | |
| | H | 8 | 3.00 | 0.1380 | 8.22 | 0.489 | | |
| (iii) | A | 24 | 5.15 | 0.1400 | 23.75 | 1.460 | 325.2 | FIG. 9 |
| | B | 24 | 5.00 | 0.1390 | 22.55 | 1.366 | | |
| | C | 60 | 4.60 | 0.1390 | 19.10 | 1.156 | | |
| | D | 96 | 4.50 | 0.1390 | 18.28 | 1.107 | | |
| | E | 60 | 4.20 | 0.1390 | 15.93 | 0.964 | | |
| | F | 14 | 4.10 | 0.1390 | 15.19 | 0.919 | | |
| | G | 24 | 2.90 | 0.1390 | 7.63 | 0.460 | | |
| (iv) | A | 50 | 4.20 | 0.1530 | 14.49 | 1.062 | 324.5 | FIG. 10 |
| | B | 210 | 3.75 | 0.1520 | 11.64 | 0.841 | | |
| | C | 110 | 3.30 | 0.1520 | 9.03 | 0.652 | | |
| | D | 40 | 3.10 | 0.1520 | 7.98 | 0.575 | | |
| (vi) | A | 18 | 5.60 | 0.1350 | 29.10 | 1.664 | 325.3 | FIG. 12 |
| | B | 102 | 5.10 | 0.1340 | 24.33 | 1.370 | | |
| | C | 24 | 4.85 | 0.1340 | 22.01 | 1.239 | | |
| | D | 18 | 4.50 | 0.1340 | 18.96 | 1.067 | | |
| | E | 72 | 4.25 | 0.1340 | 16.92 | 0.952 | | |
| | F | 36 | 3.90 | 0.1340 | 14.26 | 0.802 | | |
| | G | 24 | 2.75 | 0.1300 | 7.34 | 0.387 | | |

TABLE 15

| Type | Kind | Distribution of dimples | | | | | | | | |
|---|---|---|---|---|---|---|---|---|---|---|
| | | First region | Second region | Third region | Fourth region | Fifth region | Sixth region | Seventh region | Eighth region | Ninth region |
| (i) | A | — | — | — | — | 30 | 20 | 20 | — | — |
| | B | 24 | 12 | 12 | 40 | — | — | — | — | — |
| | C | 18 | 24 | 14 | — | — | — | — | — | — |
| | D | 6 | 16 | 4 | — | — | — | — | — | — |
| | E | — | — | 12 | 10 | — | — | — | 20 | — |
| | F | 12 | 8 | — | — | — | — | — | — | — |
| | G | — | — | 8 | — | — | — | — | — | 10 |
| | H | — | — | 6 | — | — | — | — | — | 2 |
| (iii) | A | 12 | — | — | 12 | — | — | — | — | — |
| | B | — | — | — | 12 | — | — | 12 | — | — |
| | C | 24 | 24 | 12 | — | — | — | — | — | — |
| | D | — | — | — | 24 | 24 | 36 | — | 12 | — |
| | E | 24 | 24 | 12 | — | — | — | — | — | — |
| | F | — | — | — | — | — | — | 12 | — | 2 |
| | G | — | 12 | — | — | 12 | — | — | — | — |
| (iv) | A | — | — | — | 10 | — | 30 | — | 10 | — |
| | B | 40 | 30 | 20 | 50 | 40 | — | 20 | 10 | — |
| | C | 30 | 20 | 30 | — | 10 | — | 10 | — | 10 |
| | D | — | 20 | 20 | — | — | — | — | — | — |
| (vi) | A | 12 | — | — | — | — | — | 6 | — | — |
| | B | 6 | 12 | 24 | 30 | 18 | 12 | — | — | — |
| | C | 24 | — | — | — | — | — | — | — | — |
| | D | — | — | — | 6 | — | — | 12 | — | — |
| | E | 12 | 12 | 6 | — | 12 | 12 | 6 | 6 | 6 |
| | F | — | 12 | — | 12 | — | — | — | 12 | — |
| | G | — | 6 | 12 | — | — | 6 | — | — | — |

[Measurement of Resilience Coefficient]

The golf ball was rendered to hit by an aluminum hollow cylinder having a weight of 200 g at a velocity of 40 m/s. The velocity of the hollow cylinder before and after the hitting and the velocity of the golf ball after the hitting were measured to obtain a resilience coefficient of the golf ball. Mean values of the data obtained by 12 times measurement are shown in the Tables 16 and 17 below expressed with index number presuming 1.00 as the resilience coefficient of the golf ball in Comparative Example 1.

[Flight Distance Test]

A driver with a titanium head (trade name "XXIO", available from SRI Sports Limited, shaft hardness: R, loft angle: 11°) was attached to a swing machine, available from Golf Laboratory Co. The golf ball was hit under the condition to provide a head speed of 40 m/sec, and the distance from the launching point to the point where the ball stopped was measured. Mean values of the data obtained by 12 times measurement are shown in Tables 16 and 17 below.

[Evaluation of Durability]

The golf balls were rendered to hit repeatedly on a metal plate at a velocity of 45 m/s, and the number of times of the hits until the golf ball was broken was counted. Ten golf balls were measured and each mean value was calculated. Results of the measurement are shown in Tables 16 and 17 below expressed with index number presuming 100 as the value of Comparative Example 1.

[Evaluation of Feel at Impact]

Using a driver, the golf balls were hit by 10 golf players and a hearing about feel at impact was held. Then, the feel at impact was rated according to the ranks below.

A: the number of the golf players who had favorable feel at impact is 8 or more.

B: the number of the golf players who had favorable feel at impact is 6 or more and 7 or less.

C: the number of the golf players who had favorable feel at impact is 4 or more and 5 or less.

D: the number of the golf players who had favorable feel at impact is less than 3.

The results are presented in Tables 16 to 17 below.

TABLE 16

| | | Results of evaluation | | | |
|---|---|---|---|---|---|
| | | Example 4 | Example 5 | Example 6 | Example 7 |
| Center | Type | l | m | l | l |
| Mid layer | Type | p | p | q | u |
| | D Hardness Xm | 35 | 35 | 35 | 43 |
| | flexural rigidity Ym (MPa) | 52 | 52 | 50.5 | 82 |
| | (Ym/Xm)/(Yo/Xo) | 1.08 | 1.08 | 1.05 | 1.09 |
| | Thickness (mm) | 1.0 | 1.0 | 1.0 | 1.0 |
| | Panatetra WZ-0501 | 5.0 | 5.0 | 0.3 | 5.0 |

TABLE 16-continued

| | | | Results of evaluation | | | |
|---|---|---|---|---|---|---|
| | | | Example 4 | Example 5 | Example 6 | Example 7 |
| Cover | Type | | v | x | v | v |
| | D Hardness | | 61 | 64 | 61 | 61 |
| | Thickness (mm) | | 1.3 | 1.2 | 1.3 | 1.3 |
| Amount of compressive deformation | Center C1 (mm) | | 3.40 | 3.00 | 3.40 | 3.40 |
| | Ball C3 (mm) | | 2.80 | 2.45 | 2.80 | 2.70 |
| | C1 − C3 (mm) | | 0.60 | 0.55 | 0.60 | 0.70 |
| Dimple | Type | | (i) | (i) | (i) | (i) |
| | Number of Kinds | N1 | 4 | 4 | 4 | 4 |
| | | N2 | 4 | 4 | 4 | 4 |
| | | N3 | 4 | 4 | 4 | 4 |
| | | N4 | 2 | 2 | 2 | 2 |
| | | N5 | 1 | 1 | 1 | 1 |
| | | N6 | 1 | 1 | 1 | 1 |
| | | N7 | 1 | 1 | 1 | 1 |
| | | N8 | 1 | 1 | 1 | 1 |
| | | N9 | 0 | 0 | 0 | 0 |
| | | NL | 5 | 5 | 5 | 5 |
| | | NH | 3 | 3 | 3 | 3 |
| | | NHm | 3 | 3 | 3 | 3 |
| | | NHp | 2 | 2 | 2 | 2 |
| | Total number | | 328 | 328 | 328 | 328 |
| | Ratio Pn (%) | | 92.1 | 92.1 | 92.1 | 92.1 |
| Resilience coefficient (index) | | | 1.02 | 1.04 | 1.01 | 1.02 |
| Flight distance (m) | | | 195.5 | 197.0 | 194.5 | 195.8 |
| Durability (index) | | | 110 | 105 | 102 | 103 |
| Feel at impact | | | A | A | A | A |

TABLE 17

| | | | Results of evaluation | | | |
|---|---|---|---|---|---|---|
| | | | Comp. Example 11 | Comp. Example 12 | Comp. Example 13 | Comp. Example 14 |
| Center | Type | | l | n | l | l |
| Mid layer | Type | | o | r | s | t |
| | D Hardness Xm | | 35 | 50 | 35 | 37 |
| | flexural rigidity Ym (MPa) | | 48 | 105 | 48 | 52.5 |
| | (Ym/Xm)/(Yo/Xo) | | — | — | 1.00 | 1.03 |
| | Thickness (mm) | | 1.0 | 1.0 | 1.0 | 1.0 |
| | Panatetra WZ-0501 | | — | — | — | — |
| Cover | Type | | w | x | v | w |
| | D Hardness | | 58 | 64 | 61 | 58 |
| | Thickness (mm) | | 1.3 | 1.6 | 1.3 | 1.3 |
| Amount of compressive deformation | Center C1 (mm) | | 3.40 | 3.80 | 3.40 | 3.40 |
| | Ball C3 (mm) | | 2.90 | 2.80 | 2.80 | 2.80 |
| | C1 − C3 (mm) | | 0.50 | 1.00 | 0.60 | 0.60 |
| Dimple | Type | | (iii) | (i) | (iv) | (vi) |
| | Number of kinds | N1 | 3 | 4 | 2 | 4 |
| | | N2 | 2 | 4 | 2 | 3 |
| | | N3 | 2 | 4 | 2 | 2 |
| | | N4 | 3 | 2 | 2 | 3 |
| | | N5 | 1 | 1 | 2 | 2 |
| | | N6 | 1 | 1 | 1 | 2 |
| | | N7 | 2 | 1 | 2 | 3 |
| | | N8 | 1 | 1 | 2 | 2 |
| | | N9 | 1 | 0 | 1 | 1 |
| | | NL | 3 | 5 | 2 | 5 |
| | | NH | 4 | 3 | 3 | 5 |
| | | NHm | 3 | 3 | 3 | 4 |
| | | NHp | 3 | 2 | 3 | 4 |
| | Total number | | 302 | 328 | 410 | 294 |
| | Ratio Pn (%) | | 92.1 | 92.1 | 90.2 | 91.8 |
| Resilience coefficient (index) | | | 1.00 | 1.03 | 0.99 | 1.01 |
| Flight distance (m) | | | 193.0 | 194.0 | 193.0 | 193.5 |
| Durability (index) | | | 100 | 97 | 100 | 98 |
| Feel at impact | | | A | C | A | B |

As shown in Tables 16 to 17, golf balls in Examples are excellent in all evaluation terms. Accordingly, advantages of the present invention are clearly indicated by this result of evaluation.

The golf ball according to the present invention can be used for playing at golf courses or practicing at driving ranges. The description herein above is merely for illustrative examples, and various modifications can be made without departing from the principles of the present invention.

What is claimed is:

1. A golf ball which comprises a spherical core and a cover positioned outside of the core, the core having a spherical center and a mid layer positioned outside of the center, wherein the mid layer comprises a polymer composition containing a metal oxide with a three-dimensional shape, a D hardness of the mid layer is 32 or greater and 39 or less, a ratio (C1/C2) of an amount of compressive deformation C1 of the center to an amount of compressive deformation C2 of the core is less than 1.09, a ratio (C1/C3) of the amount of compressive deformation C1 of the center to an amount of compressive deformation C3 of the golf ball is equal to or greater than 1.18, the golf ball having three or more kinds of dimples, each having a different diameter, on the surface thereof, a total number of the dimples is 300 or greater, a ratio Pn of the number of the dimples with a diameter of equal to or greater than 3.40 mm to the total number of the dimples is equal to or greater than 90%, NL and NH, which each represent numbers of kinds of dimples, satisfy formula (I) below, and NL, NHm and NHp, which each represent numbers of kinds of dimples, satisfy formula (II) below:

$$NL-NH \geqq 0 \quad \text{(I)}$$

wherein in formula (I), NL represents the number of dimples located in a low latitude region having a latitude that is zero degrees or greater and less than 30 degrees, and having a diameter of equal to or greater than 3.40 mm; and NH represents the number of dimples located in a high latitude region having a latitude that is 30 degrees or greater and 90 degrees or less, and having a diameter of equal to or greater than 3.40 mm; and $$NL > NHm \geqq NHp \quad \text{(II)}$$

wherein in formula (II), NL represents the number of dimples located in a low latitude region having a latitude that is zero degrees or greater and less than 30 degrees, and having a diameter of equal to or greater than 3.40 mm; NHm represents the number of dimples located in a middle region having a latitude that is 30 degrees or greater and less than 60 degrees, and having a diameter of equal to or greater than 3.40 mm; and NHp represents the number of dimples located in a polar region having a latitude that is 60 degrees or greater and 90 degrees or less, and having a diameter of equal to or greater than 3.40 mm.

2. The golf ball according to claim 1 wherein the amount of compressive deformation C3 is 3.2 mm or greater and 3.8 mm or less.

3. The golf ball according to claim 1, wherein NL, NHm and NHp, which each represent numbers of kinds of dimples, satisfy formula (III) below:

$$NL > NHm > NHp \quad \text{(III)}.$$

4. The golf ball according to claim 1, wherein N1 to N9, which each represent numbers of kinds of dimples, satisfy the following formula (IV):

$$N1 \geqq N2 \geqq N3 > N4 \geqq N5 \geqq N6 \geqq N7 \geqq N8 \geqq N9 \quad \text{(IV)}$$

wherein in this formula (IV), N1 represents the number of dimples located in a first region having a latitude that is zero degrees or greater and less than 10 degrees, and having a diameter of equal to or greater than 3.40 mm; N2 represents the number of dimples located in a second region having a latitude that is 10 degrees or greater and less than 20 degrees, and having a diameter of equal to or greater than 3.40 mm; N3 represents the number of dimples located in a third region having a latitude that is 20 degrees or greater and less than 30 degrees, and having a diameter of equal to or greater than 3.40 mm; N4 represents the number of dimples located in a fourth region having a latitude that is 30 degrees or greater and less than 40 degrees, and having a diameter of equal to or greater than 3.40 mm; N5 represents the number of dimples located in a fifth region having a latitude that is 40 degrees or greater and less than 50 degrees, and having a diameter of equal to or greater than 3.40 mm; N6 represents the number of dimples located in a sixth region having a latitude that is 50 degrees or greater and less than 60 degrees, and having a diameter of equal to or greater than 3.40 mm; N7 represents the number of dimples located in a seventh region having a latitude that is 60 degrees or greater and less than 70 degrees, and having a diameter of equal to or greater than 3.40 mm; N8 represents the number of dimples located in an eighth region having a latitude that is 70 degrees or greater and less than 80 degrees, and having a diameter of equal to or greater than 3.40 mm; and N9 represents the number of dimples located in a ninth region having a latitude that is 80 degrees or greater and 90 degrees or less, and having a diameter of equal to or greater than 3.40 mm.

5. A golf ball comprising a spherical center, a mid layer positioned outside of the center and a cover positioned outside of the mid layer, wherein the mid layer comprises a polymer composition containing a metal oxide with a three-dimensional shape, a D hardness of the mid layer is 30 or greater and 45 or less, a D hardness of the cover is 59 or greater, a difference (C1-C3) between an amount of compressive deformation C1 of the center and an amount of compressive deformation C3 of the golf ball is equal to or less than 0.75 mm, the golf ball has three or more kinds of dimples, each having a different diameter, on the surface thereof, a total number of the dimples is 300 or greater, a ratio Pn of the number of the dimples with a diameter of equal to or greater than 3.40 mm to the total number of the dimples is equal to or greater than 90%, NL and NH, which each represent numbers of kinds of dimples, satisfy formula (I) below, and NL, NHm and NHp, which each represent numbers of kinds of the dimples, satisfy formula (II) below:

$$NL-NH \geqq 0 \quad \text{(I)}$$

wherein in formula (I), NL represents the number of dimples located in a low latitude region latitude that is zero degrees or greater and less than 30 degrees, and having a diameter of equal to or greater than 3.40 mm; and NH represents the number of dimples located in a high latitude region having a latitude that is 30 degrees or greater and 90 degrees or less, and having a diameter of equal to or greater than 3.40 mm;

$$NL<NHm\geqq NHp \quad (II)$$

wherein in formula (II), NL represents the number of dimples located in a low latitude region having a latitude that is zero degrees or greater and less than 30 degrees, and having a diameter of equal to or greater than 3.40 mm; NHm represents the number of dimples located in a middle region having a latitude that is 30 degrees or greater and less than 60 degrees, and having a diameter of equal to or greater than 3.40 mm; and NHp represents the number of dimples located in a polar region having a latitude that is 60 degrees or greater and 90 degrees or less, and having a diameter of equal to or greater than 3.40 mm.

6. The golf ball according to claim 5, wherein the mid layer has a thickness of equal to or less than 1.2 mm and the cover has a thickness of equal to or less than 1.4 mm.

7. The golf ball according to claim 5, wherein the amount of the metal oxide to be blended is 0.5 part by weight or greater and 20 parts by weight or less per 100 parts by weight of base polymer.

8. The golf ball according to claim 5, wherein the metal oxide is zinc oxide.

9. The golf ball according to claim 5, wherein a ratio R which is calculated by the following formula (V) is equal to or greater than 1.05;

$$R=((Ym/Xm)/(Yo/Xo)) \quad (V)$$

wherein in formula (V), Ym represents flexural rigidity (MPa) of the polymer composition of the mid layer, Xm represents a D hardness of the polymer composition, Yo represents flexural rigidity (MPa) of a base resin of the mid layer, and Xo represents a D hardness of the base resin.

10. The golf ball according to claim 5, wherein NL, NHm and NHp, which each represent numbers of kinds of dimples, satisfy the following formula (III):

$$NL>NHm>NHp \quad (III).$$

11. The golf ball according to claim 5, wherein N1 to N9, which represent a number of kinds of the dimples, meet the following formula (IV):

$$N1\geqq N2\geqq N3>N4\geqq N5\geqq N6\geqq N7\geqq N8\geqq N9 \quad (IV)$$

wherein in formula (IV), N1 represents the number of dimples located in a first region having a latitude that is zero degrees or greater and less than 10 degrees, and having a diameter of equal to or greater than 3.40 mm; N2 represents the number of dimples located in a second region having a latitude that is 10 degrees or greater and less than 20 degrees, and having a diameter of equal to or greater than 3.40 mm; N3 represents the number of dimples located in a third region having a latitude that is 20 degrees or greater and less than 30 degrees, and having a diameter of equal to or greater than 3.40 mm; N4 represents the number of dimples located in a fourth region having a latitude that is 30 degrees or greater and less than 40 degrees, and having a diameter of equal to or greater than 3.40 mm; N5 represents the number of dimples located in a fifth region having a latitude that is 40 degrees or greater and less than 50 degrees, and having a diameter of equal to or greater than 3.40 mm; N6 represents the number of dimples located in a sixth region having a latitude that is 50 degrees or greater and less than 60 degrees, and having a diameter of equal to or greater than 3.40 mm; N7 represents the number of dimples located in a seventh region having a latitude that is 60 degrees or greater and less than 70 degrees, and having a diameter of equal to or greater than 3.40 mm; N8 represents the number of dimples located in an eighth region having a latitude that is 70 degrees or greater and less than 80 degrees, and having a diameter of equal to or greater than 3.40 mm; and N9 represents the number of dimples located in a ninth region having a latitude that is 80 degrees or greater and 90 degrees or less, and having a diameter of equal to or greater than 3.40 mm.

12. The golf ball according to claim 1, wherein the ratio (C1/C2) is less than 1.08 and equal to or greater than 1.03; and wherein the ratio (C1/C3) is equal to or greater than 1.20.

13. The golf ball according to claim 4, wherein the ratio (C1/C2) is less than 1.08 and equal to or greater than 1.03; and wherein the ratio (C1/C3) is equal to or greater than 1.20.

14. The golf ball according to claim 9, wherein the ratio R calculated by formula (V) is equal to or greater than 1.08 and equal to or less than 1.30.

15. The golf ball according to claim 5, wherein the difference (C1-C3) is equal to or greater than 0.20 mm and equal to or less than 0.70 mm.

16. The golf ball according to claim 5, wherein the difference (C1-C3) is equal to or greater than 0.30 mm and equal to or less than 0.65 mm.

* * * * *